US005906168A

United States Patent [19]

Ito et al.

[11] Patent Number: 5,906,168

[45] Date of Patent: May 25, 1999

[54] SEWING MACHINE WITH DETACHABLE COVER

[75] Inventors: Minoru Ito, Nagoya; Katsuhiro Kitajima, Ogaki, both of Japan

[73] Assignee: Brother Kogyo Kabushiki Kaisha, Nagoya, Japan

[21] Appl. No.: 09/046,493

[22] Filed: Mar. 24, 1998

[30] Foreign Application Priority Data

Mar. 25, 1997 [JP] Japan ..... 9-091702

[51] Int. Cl.[6] ..... D05C 9/06; D05B 77/00

[52] U.S. Cl. ..... 112/103; 112/258; D15/75

[58] Field of Search ..... 112/103, 470.06, 112/102.5, 258, 260, 217.1; 312/208.5; D15/75

[56] References Cited

U.S. PATENT DOCUMENTS

| | | | |
|---|---|---|---|
| 3,822,659 | 7/1974 | Maag | 112/258 |
| 4,127,077 | 11/1978 | Fresard | 112/258 |
| 5,231,941 | 8/1993 | Wakayama . | |
| 5,355,319 | 10/1994 | Matsubara . | |
| 5,666,894 | 9/1997 | Jonsson | 112/103 |

FOREIGN PATENT DOCUMENTS

| | | | |
|---|---|---|---|
| 907951 | 7/1945 | France | 112/260 |
| Y2-63-21265 | 6/1988 | Japan . | |
| A-5-49766 | 3/1993 | Japan . | |
| A-5-49768 | 3/1993 | Japan . | |
| A-7-328274 | 12/1995 | Japan . | |

*Primary Examiner*—Peter Nerbun
*Attorney, Agent, or Firm*—Oliff & Berridge, PLC

[57] ABSTRACT

A sewing machine cover 2 includes a cover main body 7 and an extension cover portion 8. The cover main body 7 houses a left-right embroidery-frame drive mechanism 60 for driving an embroidery frame 50 in leftward and rightward directions. The extension cover portion 8 houses a front-rear embroidery-frame drive mechanism 80 for driving the embroidery frame 50 in front and rear directions. An opening 35 for engaging with an engagement portion 11 of a bed portion 3 is formed in a wall 31 of the cover main portion 7. When the sewing machine cover 2 is used as a cover of a sewing machine M, a bed surface 12 and an upper surface of the wall 31 form a substantially continuous work surface.

22 Claims, 19 Drawing Sheets

SEWING MACHINE WITH DETACHABLE COVER

BACKGROUND OF THE INVENTION

1. Field of the Invention

The present invention relates to a sewing machine having a bed portion, an arm portion extending parallel with the bed portion, and a cover capable of at least partially covering a space between the bed portion and the arm portion.

2. Description of the Related Art

A variety of sewing machines are known in the art. Sewing machines have a frame with a bed portion, a column portion extending upright from the bed portion, and an arm portion extending from the column portion in a horizontal direction over the bed portion in parallel with the bed portion.

In some sewing machines, the bed portion includes a free arm portion at the end not connected to the column portion. The free arm portion enables the user to easily sew patterns on or stitches in bags or cylindrical-shaped objects, such as shirt sleeves and cuffs of pants.

Japanese Utility-Model-Application Publication No. SHO-63-21265 discloses a sewing machine with a cover capable of at least partially covering the bed portion and the arm portion of the sewing machine and also capable of serving as a supplementary table for increasing work surface of the bed portion during the sewing.

There are also a variety of embroidery sewing machines capable of performing embroidery sewing operations in addition to normal sewing operations. Such embroidery sewing machines include: an embroidery frame in which a workpiece cloth is supported; and left-right and front-rear embroidery-frame drive mechanisms for independently driving movement of the embroidery frame leftward, rightward, frontward, and rearward across the work surface of the bed.

Embroidery sewing machines can be divided into two major types: internal embroidery-frame drive mechanism types, wherein the embroidery-frame drive mechanism for driving the embroidery frame is accommodated in the bed portion of the embroidery sewing machine; and detachable embroidery-frame drive mechanism types, wherein the embroidery-frame drive mechanism of the embroidery frame is detachable provided to the bed portion.

Japanese Patent-Application Publication No. HEI-7-328274 describes an internal embroidery-frame drive mechanism type embroidery sewing machine, wherein one end of the bed portion is formed with a free arm and wherein the left-right embroidery-frame drive mechanism and the front-rear embroidery-frame drive mechanism are housed in a base of the sewing machine under the bed portion.

U.S. Pat. No. 5,231,941 describes a detachable embroidery-frame drive mechanism type embroidery sewing machine having an embroidery device detachably provided to a free arm portion of the bed. The embroidery device houses a left-right embroidery-frame drive mechanism and a front-rear embroidery-frame drive mechanism for driving movement of an embroidery frame over the upper surface of the bed portion via a movement body provided to the upper surface of the embroidery device.

SUMMARY OF THE INVENTION

The internal embroidery-frame drive mechanism type embroidery sewing machine described in Japanese Patent-Application Publication No. HEI-7-328274 has a relatively large base portion for accommodating the left-right embroidery-frame drive mechanism and the front-rear embroidery-frame drive mechanism. Further, to increase the area of the upper surface of the bed, a separate supplementary table needs to be provided. Additionally, to cover the space between the arm portion and the bed portion, a separate cover needs to be provided. Such a configuration requires a great number of parts, is expensive to produce, and makes the sewing machine difficult to carry and store, and so is inconvenient.

The detachable embroidery-frame drive mechanism type embroidery sewing machine described in U.S. Pat. No. 5,231,941 also has room for improvement. For example, the embroidery device that houses the embroidery-frame drive mechanisms can not be used as a supplementary table because the movement body on the upper surface of the embroidery device would interfere with normal sewing operations. Therefore, in order to increase the upper surface of the bed portion during normal sewing operations, a separate supplementary table must be provided. Further, a separate cover is required to cover the space between the arm portion and the bed portion. Therefore, this device requires a great number of parts, is expensive to produce, and is inconvenient to carry and store away, for example, in a closet.

The device described in Japanese Utility-Model-Application Publication No. SHO-63-21265 described a cover that can be used as a cover and as a supplementary table for a sewing machine. However this sewing machine has no device for performing embroidery sewing.

The present inventors have considered producing a sewing machine cover that can be used as a sewing machine cover and also as a supplementary table, wherein embroidery frame movement mechanisms are housed in the sewing machine cover. However, the sewing machine cover and the frame movement mechanisms need to be assembled in a manner that, when the cover is used as a supplementary table, secures a broad working surface during normal sewing and also a broad area for an embroidery frame to move during embroidery sewing.

It is an objective of the present invention to overcome the above-described problems and to provide a sewing machine cover which can be used as a cover and as a supplementary table for a sewing machine, wherein, when the cover is used as a supplementary table, a broad working surface can be secured during normal sewing and a broad area can be secured for an embroidery frame to move during embroidery sewing.

In order to achieve the above-described objectives, a sewing machine according to the present invention includes: a bad portion extending in leftward and rightward directions and having an upper surface; a column portion extending upright from the bed portion in a vertical direction perpendicular to the leftward and rightward directions; an arm portion extending from the column portion over the upper surface of the bed portion; and a sewing machine cover. The sewing machine cover at least partially covers the space between the bed portion and the arm portion and houses at least one of a left-right drive mechanism and a front-rear drive mechanism. The left-right drive mechanism is for driving an embroidery frame in the leftward and rightward directions across the work surface. The front-rear drive mechanism is for driving the embroidery frame in a front and rear directions perpendicular to the leftward and rightward directions and to the vertical direction across the work surface.

With this configuration, the weight of the column portion is offset by the weight of either the left-right drive mechanism, the front-rear drive mechanism, or both that are housed in the sewing machine cover. This effect of the present invention is particularly striking when a transformer, a motor, or both are disposed in the column portion and also when the left-right drive mechanism, the front-rear drive mechanism, or both are provided with a motor. Because balance of the sewing machine is good, the sewing machine can be easily carried by grasping the arm without the sewing machine tilting downward on the column side.

The sewing machine can be either a sewing machine for a left-handed user or for a right-handed user.

According to another aspect of the present invention, the sewing machine cover is also usable as a supplementary table to form a substantially continuous flush work surface in cooperation with the upper surface of the bed portion, wherein the work surface has a greater surface area than the upper surface of the bed portion.

With this configuration, when the sewing machine cover is used to partially cover the space between the bed portion and the arm portion, dust can be prevented from collecting on the work surface of the bed portion. Also the working surface of the bed portion and components in the space between the arm portion and the bed portion, such as a needle bar, a sewing needle, and a presser foot for pressing down the workpiece cloth, can be properly protected. Further, the overall sewing machine, including the sewing machine cover, has a more compact shape and so can be conveniently carried and stored away, for example, in a closet. When the sewing machine cover is used as a supplementary table, a surface of the sewing machine cover and the surface of the bed portion from a substantially continuous flush working surface, thereby increasing the work surface formed by the bed portion. As a result, a workpiece cloth can be smoothly fed during normal sewing and a broad movement area for the embroidery frame to move around in can be secured during embroidery sewing.

The sewing machine cover can be formed to enable it to more than partially cover the space between the bed portion and the arm portion. For example, the sewing machine cover can be formed to enable it to cover the front, rear, left, or upper surfaces of the arm portion, or the front and rear surfaces of the bed portion. It should be noted than when the sewing machine cover is used as a supplementary table, electrical components of the embroidery-frame drive mechanisms in the sewing machine cover and a control device within the frame of the sewing machine can be electrically connected via a connector.

According to another aspect of the present invention, an opening is formed in a side wall of the cover so as to extend from an open side of the cover. The opening is shaped so as to be engageable with the upper surface of the bed portion when the cover is used as a supplementary table.

With this configuration, the user can grasp the arm portion of the sewing machine through the opening formed in the sewing machine cover. This makes the sewing machine easy to carry around. The cover can easily be used as a supplementary table by engaging the opening with the upper surface of the bed portion. In this case, the side of the sewing machine cover in which the opening is formed will serve to increase the surface area of the upper surface of the bed portion, thereby producting a large and substantially continuous flush work surface.

The bed portion of the sewing machine can be formed with a free arm portion to enable a user to sew on bags or cylindrical objects, such as shirt sleeves or pants legs. When the sewing machine cover is formed with an opening in its side wall as described above, the side wall with no opening is formed so that when the sewing machine cover is used as a supplementary table, the side wall with no opening extends under the lower surface of the bed portion or the free arm so as not to interfere with the bed portion.

According to another aspect of the present invention, the sewing machine cover includes a main cover portion and a extension cover portion detachably provided to the main cover portion. The main cover portion houses the left-right embroidery-frame drive mechanism and the extension cover portion houses the front-rear embroidery-frame drive mechanism. Additionally, the extension cover portion forms a portion of the work surface when the sewing machine cover is used as a supplementary table.

With this configuration, the movement mechanism housing portion is driven in the leftward and rightward directions by the left-right embroidery-frame drive mechanism. That is, the left-right embroidery-frame drive mechanism drives the embroidery frame in the leftward and rightward directions via the extension cover portion and the front-rear embroidery-frame drive mechanism. The front-rear embroidery-frame drive mechanism drives the embroidery frame in the frontward and rearward directions. When the sewing machine cover is used as a supplementary table, a surface of the movement mechanism housing portion serves as a portion of the work surface so that a particularly large work surface can be secured.

According to another aspect of the present invention, the sewing machine cover is formed so that when the sewing machine cover is used as a supplementary table, a bottom surface of the extension cover portion is higher than a bottom surface of the main cover portion. With this configuration, even when the sewing machine is used placed on a desk top or the floor, the extension cover portion will not contact the surface of the floor or desk. Therefore, the extension cover portion can be smoothly driven leftward and rightward by the left-right embroidery-frame drive mechanism. This is particularly beneficial when the sewing machine is used placed on a material having a great friction coefficient, such as a table cloth or a carpet.

According to another aspect of the present invention, a step portion can be formed between the upper surface of the bed portion and side surface of the bed portion, that is, around the upper surface of the bed portion, to a height equal to thickness of the inner surface delineating the opening in the sewing machine cover. In this case, when the opening of the sewing machine cover is engaged with the upper surface of the bed portion, the inner surface of the sewing machine cover near the opening will be supported on the step portion around the upper surface. Also, the surface of the sewing machine cover and the upper surface of the bed portion will be aligned flush with each other.

Further, the step portion can be used as a guide when mounting the sewing machine cover onto the bed portion so that the sewing machine cover can be easily and smoothly mounted on the sewing machine frame. That is, when the sewing machine cover is to be mounted on the bed portion for use as a supplementary table, the step portion can be used to guide the surface of the sewing machine cover defining the opening. When the sewing machine cover is to be mounted on the bed portion for use as a cover, the step portion can be used to guide the lower edges of the sewing machine cover.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
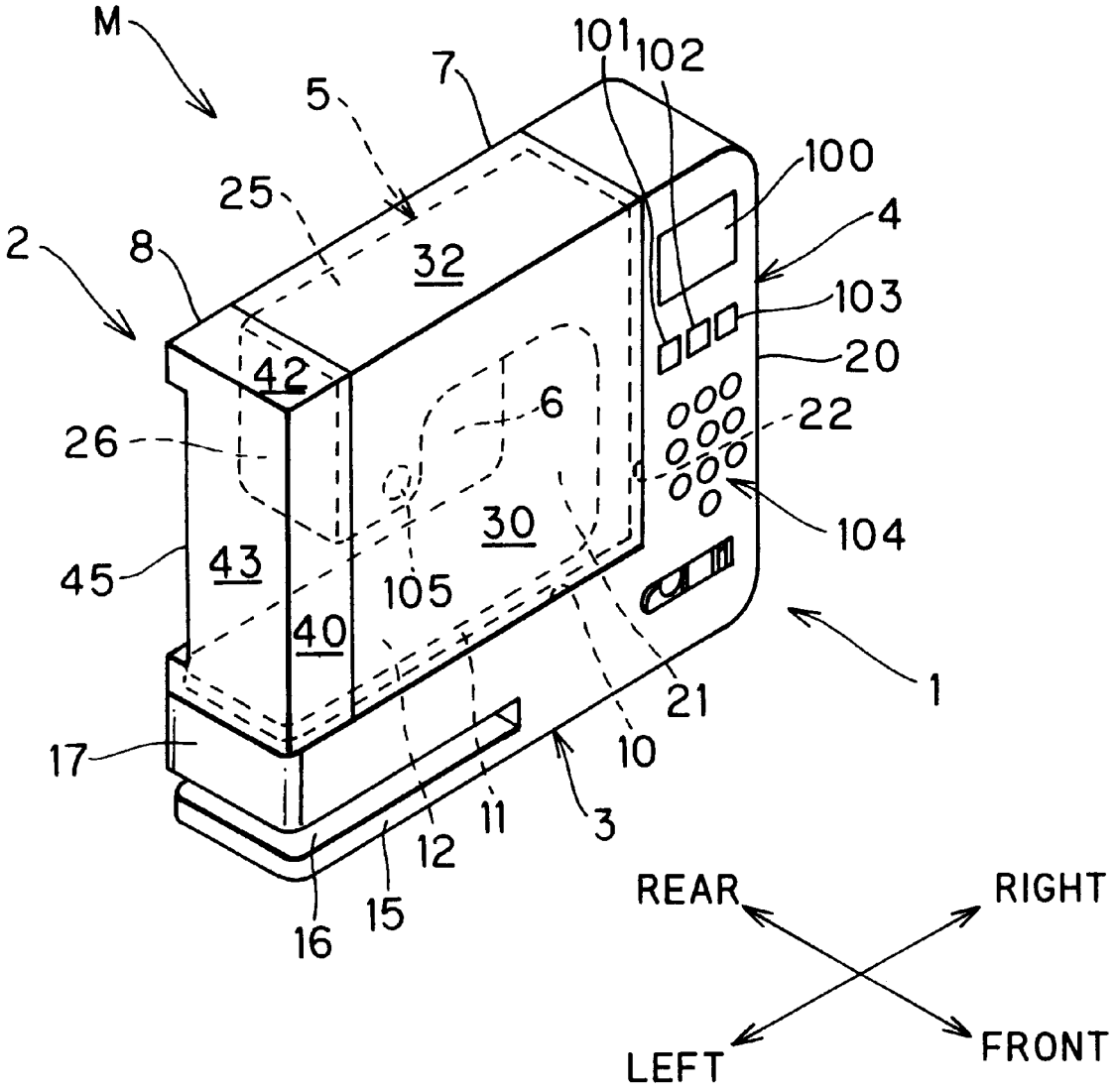
FIG. 1 is a perspective view partially in phantom showing a sewing machine having a cover according to the present invention.

A compact sewing machine M according to a preferred embodiment of the present invention will be described while referring to the accompanying drawings wherein like parts and components are designated by the same reference numerals to avoid duplication description. It should be noted that unless otherwise stated, terms such as left, right, front, rear, up, and down will be used referring to the sewing machine M oriented in the manner which it is intended to be used, that is, with the user sitting in a front direction from the sewing machine M and facing in a rear direction as indicated in FIG. 1.

The sewing machine M for household use will be described while referring to FIGS. 1 to 6. The sewing machine M includes a frame 1 and a sewing machine cover 2. The frame 1 includes a bed portion 3, a column portion 4 extending upright from the bed portion 3, and an arm portion 5 extending from the column portion 4 horizontally over the bed portion 3. A space 6 is formed between the bed portion 3 and the arm portion 5.

Figure 2:
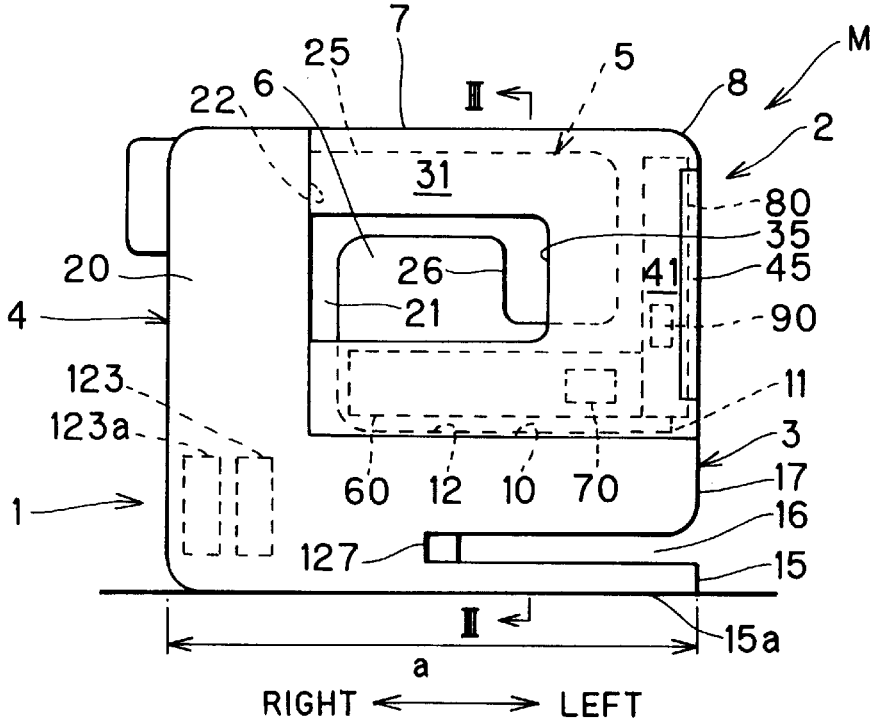
FIG. 2 is a rear view partially in phantom showing the sewing machine of FIG. 1.
Figure 3:
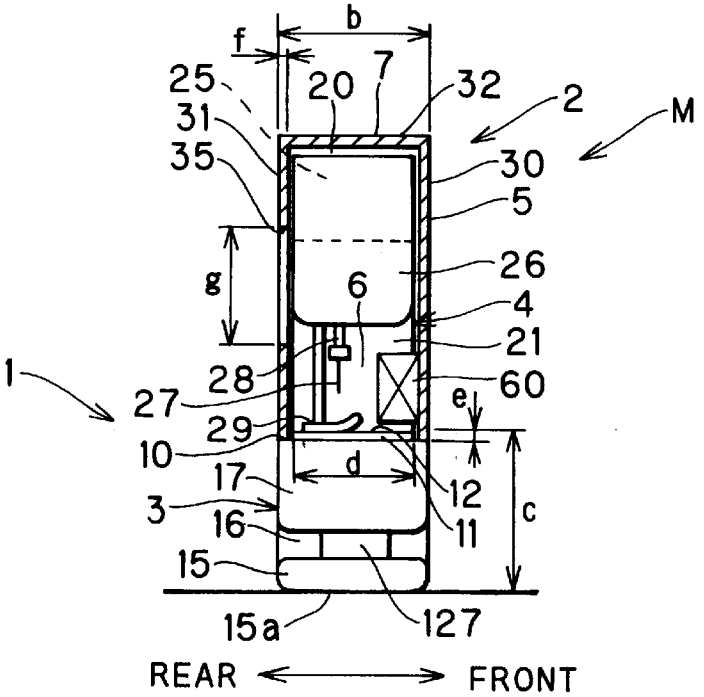
FIG. 3 is a cross-sectional view taken along line III—III of FIG. 2.
Figure 5:
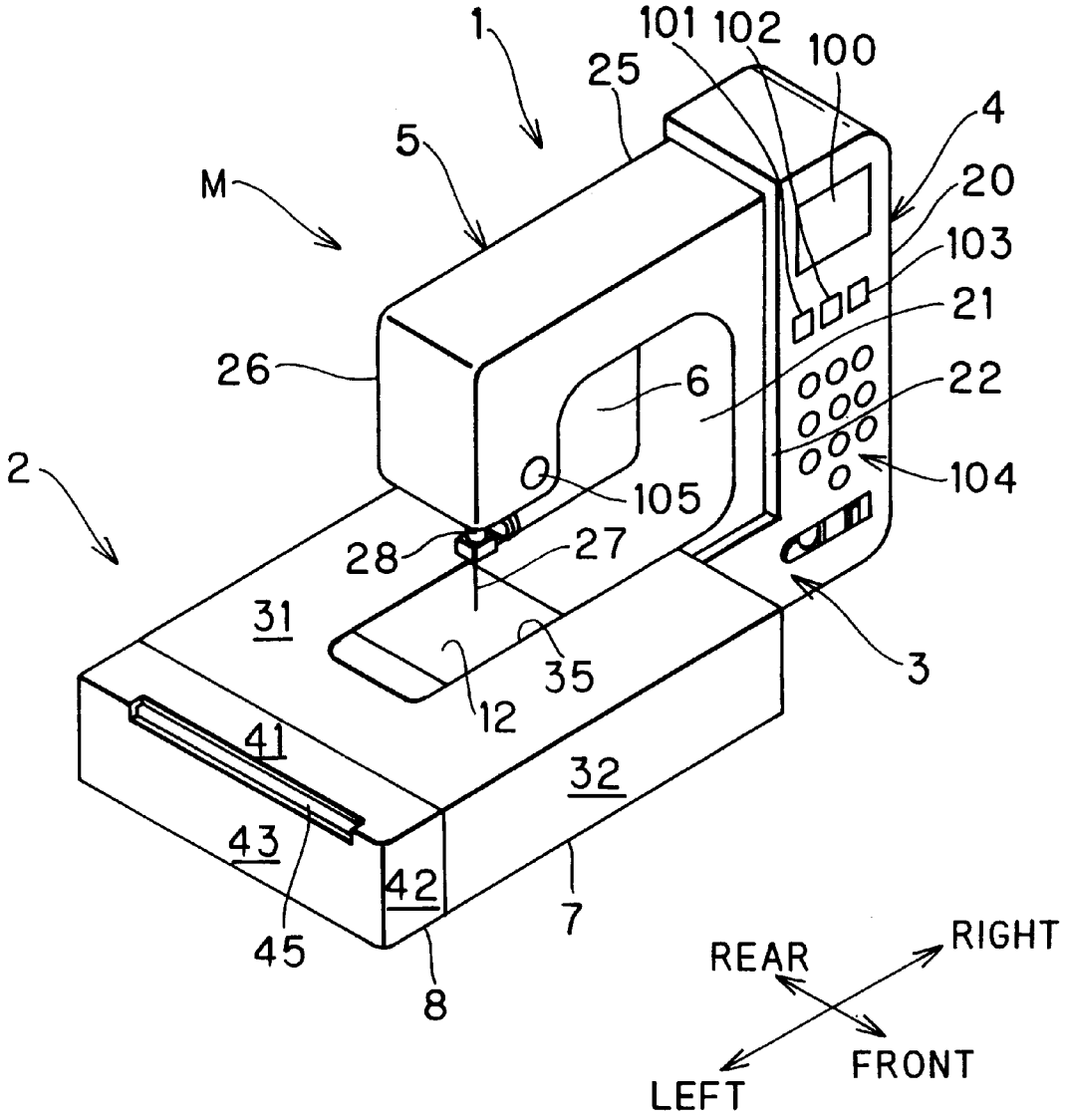
FIG. 5 is a perspective view showing the sewing machine with the cover used as a supplementary table.
Figure 6:
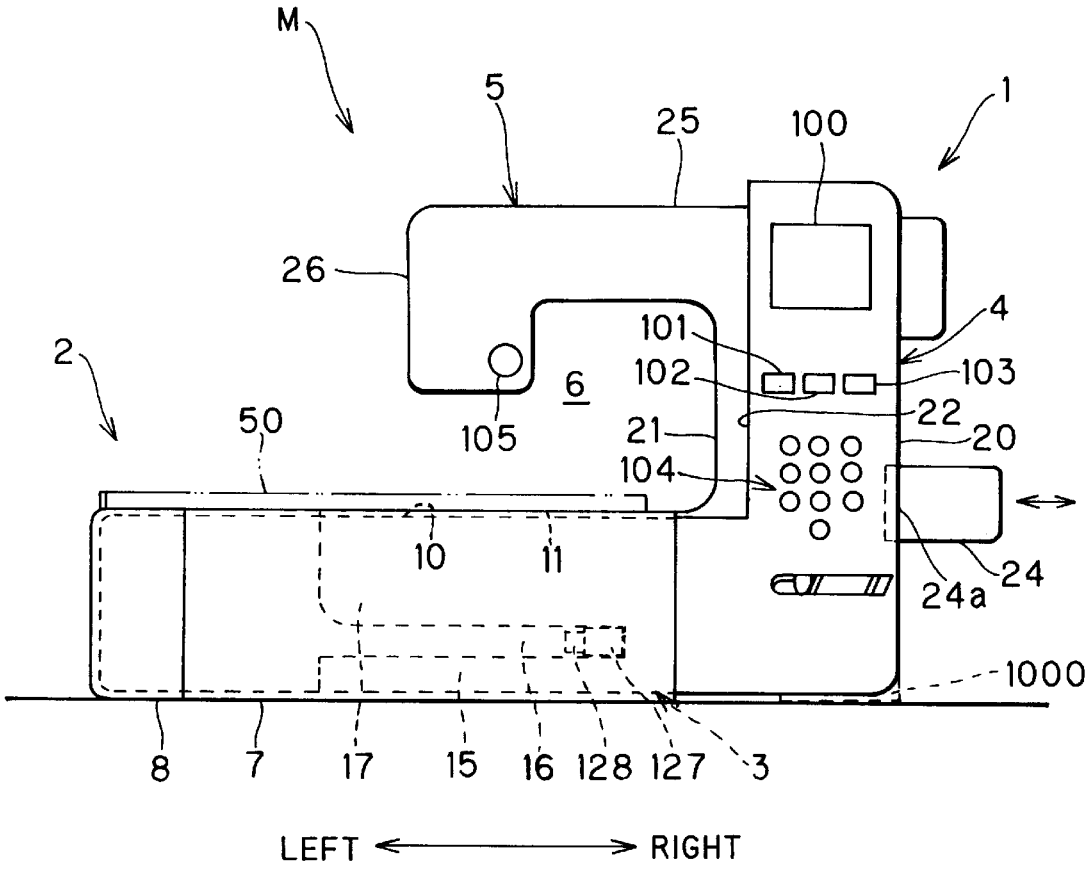
FIG. 6 is a front view showing the sewing machine with the cover used as a supplementary table.
Figure 8:
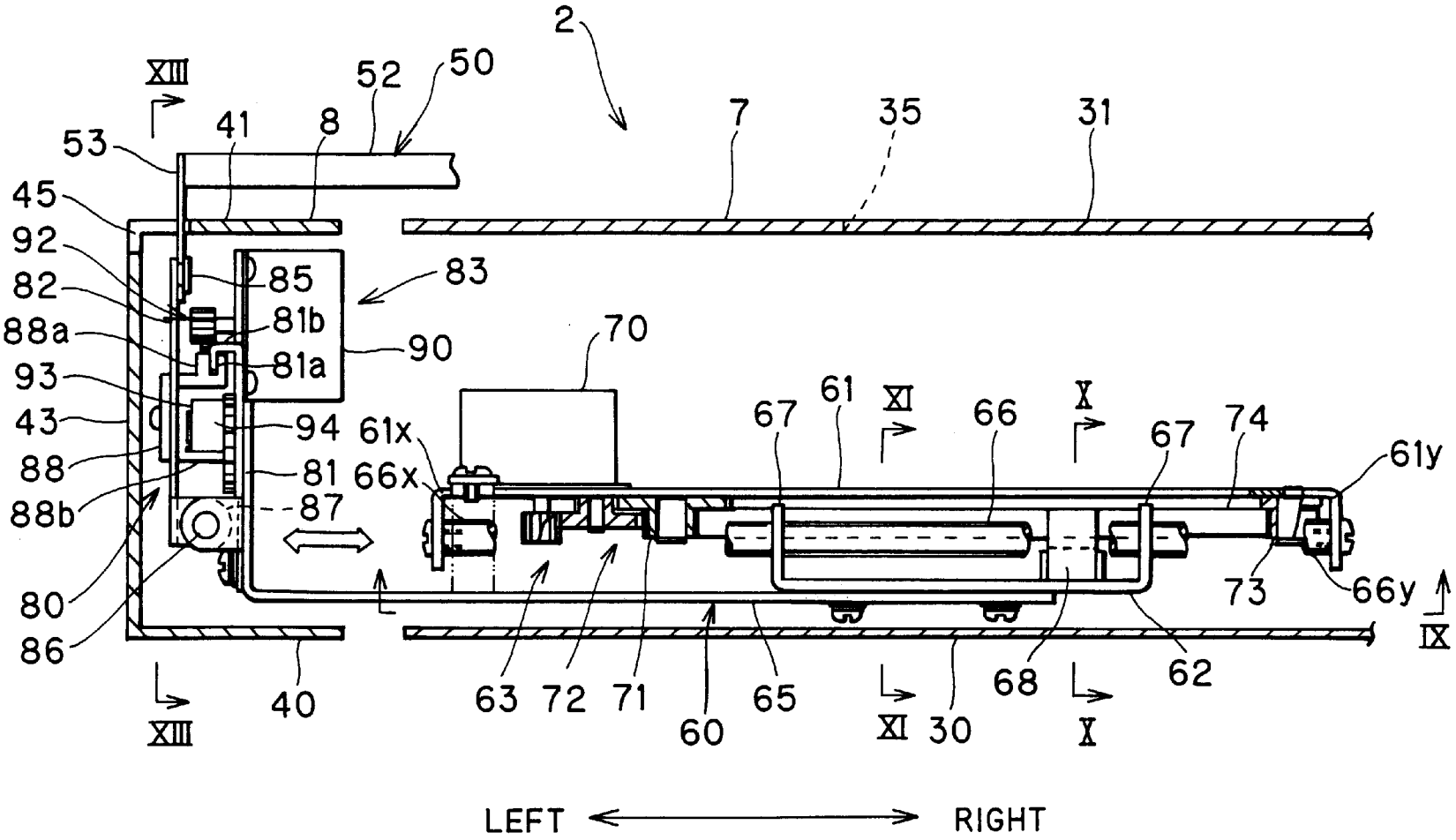
FIG. 8 is cross-sectional view, taken along line VIII—VIII of FIG. 7, showing embroidery-frame drive mechanisms housed in the cover.
Figure 17:
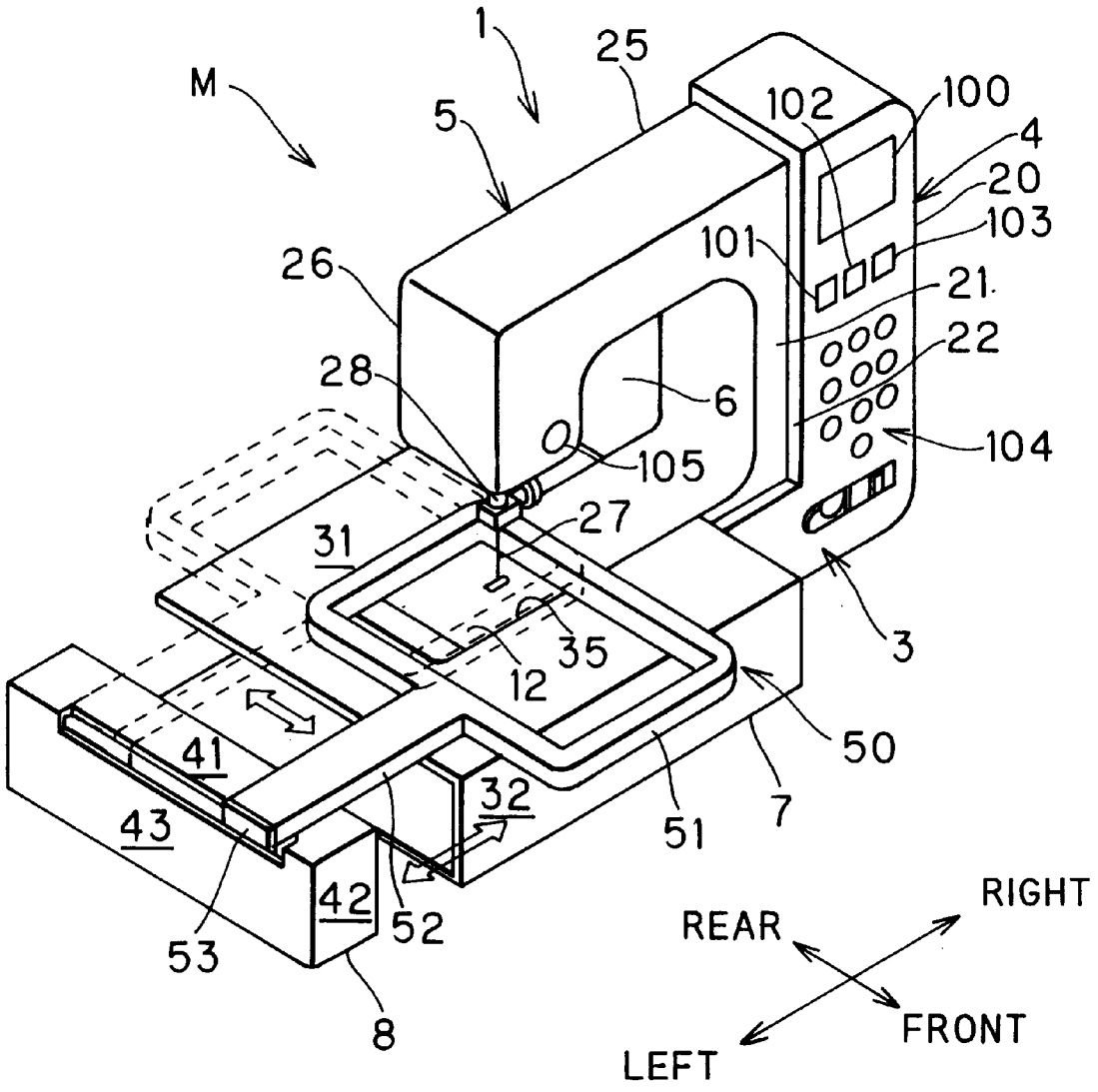
FIG. 17 is a perspective view showing a leftwardmost position and a rightwardmost position of the embroidery frame as driven by a left-right embroidery-frame drive mechanism of the embroidery-frame drive mechanisms.

As will be described in greater detail later, the sewing machine cover 2 can serve as either a cover for the frame 1 as shown in FIGS. 1 to 3 or as an embroidery-frame drive mechanism as shown in FIGS. 5 and 6. As shown in FIG. 8, the sewing machine cover 2 houses a left-right embroidery-frame drive mechanism 60 and a front-rear embroidery-frame drive mechanism 80 for driving movement of an embroidery frame 50 as shown in FIG. 17. In the present embodiment, the sewing machine cover also serves as a supplementary table when used as an embroidery-frame drive mechanisms. However, the sewing machine cover need not be usable as a supplementary table as long as the sewing machine cover can also be used as an embroidery-frame drive mechanism.

First, further description of the frame 1 will be provided. The bed portion 3 has a substantially parallelepiped shape with a front, rear, left, and right sides. The bed portion 3 includes a base portion 15, a free arm portion 17, a step portion 10, and an engagement portion 11. As shown in FIGS. 2 and 3, the bed portion 3 is formed with a length a from its right to its left sides, a width b from its front side to its rear side, and a height c from a lower surface 15*a* of the base portion 15 to a bed surface 12 of the engagement portion 11.

The base portion 15 and the free arm portion 17 are provided at the left end of the bed portion 3. The free arm portion 17 is supported at one end only so as to extend over the base portion 15 separated by an gap 16. The free arm portion 17 enables a user to easily sew on bags or cylindrical objects, such as shirt sleeves or pants legs.

The step portion 10 is formed at upper edges of the left, front, and rear sides of the bed portion 3 and is separated from the bed surface 12 by a height e. Said differently, the engagement portion 11 is defined by the step portions 10. The engagement portion 11 is formed with a width d in the frontward and rearward directions at the upper surface of the bed portion 3.

A connector 127 is provided at the right edge of the gap 16 and a connector 128 is provided to the sewing machine cover 2. As will be described later with reference to FIG. 18, the connector 127 is electrically connected to a control device C and the connector 128 is electrically connected to a left-right stepping motor 70, a front-rear stepping motor 90, and optical sensors 76, 96 in the sewing machine cover 2. When the sewing machine cover 2 is used as a supplementary table, the connector 127 is connected to the connector 128 of the sewing machine cover 2 so that the control device C is brought into electrical connection with the stepping motors 70, 90 and optical sensors 76, 96 via the connectors 127, 128. Power is also supplied from the sewing machine M to the stepping motors 70, 90 via the connectors 127, 128. It should be noted that the connectors 127, 128 need not be provided at the positions described in the present embodiment, but could be provided to other positions instead.

Although not shown in the drawings, the bed portion 3 is provided with a feed dog for feeding a workpiece cloth during normal sewing, such as straight line sewing or zigzag sewing, a feed dog vertical movement mechanism for vertically moving the feed dog, and a front-rear feed dog movement mechanism for moving the feed dog in forward and rearward directions.

As best seen in FIG. 2, the column portion 4 has a main portion 20 and an extension portion 21 extending to the left from the main portion 20 to the engagement portion 11 in continuation of the engagement portion 11. The main portion 20 is formed with the same width b from front to rear sides as the bed portion 3 and the extension portion 21 is formed with the same width d as the engagement portion 11 of the bed portion 3. An abutment surface 22 is configured from a leftward facing surface of the main portion 20 that connects with the front, rear, and upper surfaces of the extension portion 21. The abutment surface 22 abuts against the right edge of the sewing machine cover 2 when the sewing machine cover 2 is used as a cover.

As shown in FIG. 6, the column main portion 20 is formed in its right side with a card slot 24*a* for mounting a ROM card 24 in a mounting portion housed within the column main portion 20. The ROM card 24 stores embroidery data about a variety of embroidery patterns. A variety of components are provided on the front surface of the column main portion 20, including a liquid crystal display 100 for displaying a variety of messages and sewing patterns: pattern selection keys 104 formed from a ten key pad for selecting a desired sewing pattern; a start key 101 for starting sewing operations for sewing a selected embroidery pattern; a stop key 102 for interrupting sewing operations; and a restart key 103 for restarting sewing operations interrupted by operation of the stop key 102.

As shown in, for example, FIG. 2, the arm portion 5 includes an arm main body 25 in continuation with the extension portion 21 of the column portion 4 and a head portion 26 provided at the left tip of the arm main body 25. As shown in FIG. 3, the arm main body 25 is formed with the same width d as the engagement portion 11 of the bed portion 3 and as the extension portion 21 of the column portion 4.

A needle bar 28 and a presser foot 29 are provided to the lower edge of the head portion 26. The needle bar 28 is mounted with a detachable sewing needle 27. The presser foot 29 is detachably supported to the rear of the sewing needle 27. As shown in FIG. 1, a start/stop switch 105 and the like for commanding start and stop of normal sewing operations is provided to the front surface of the head portion 26.

Figure 18:
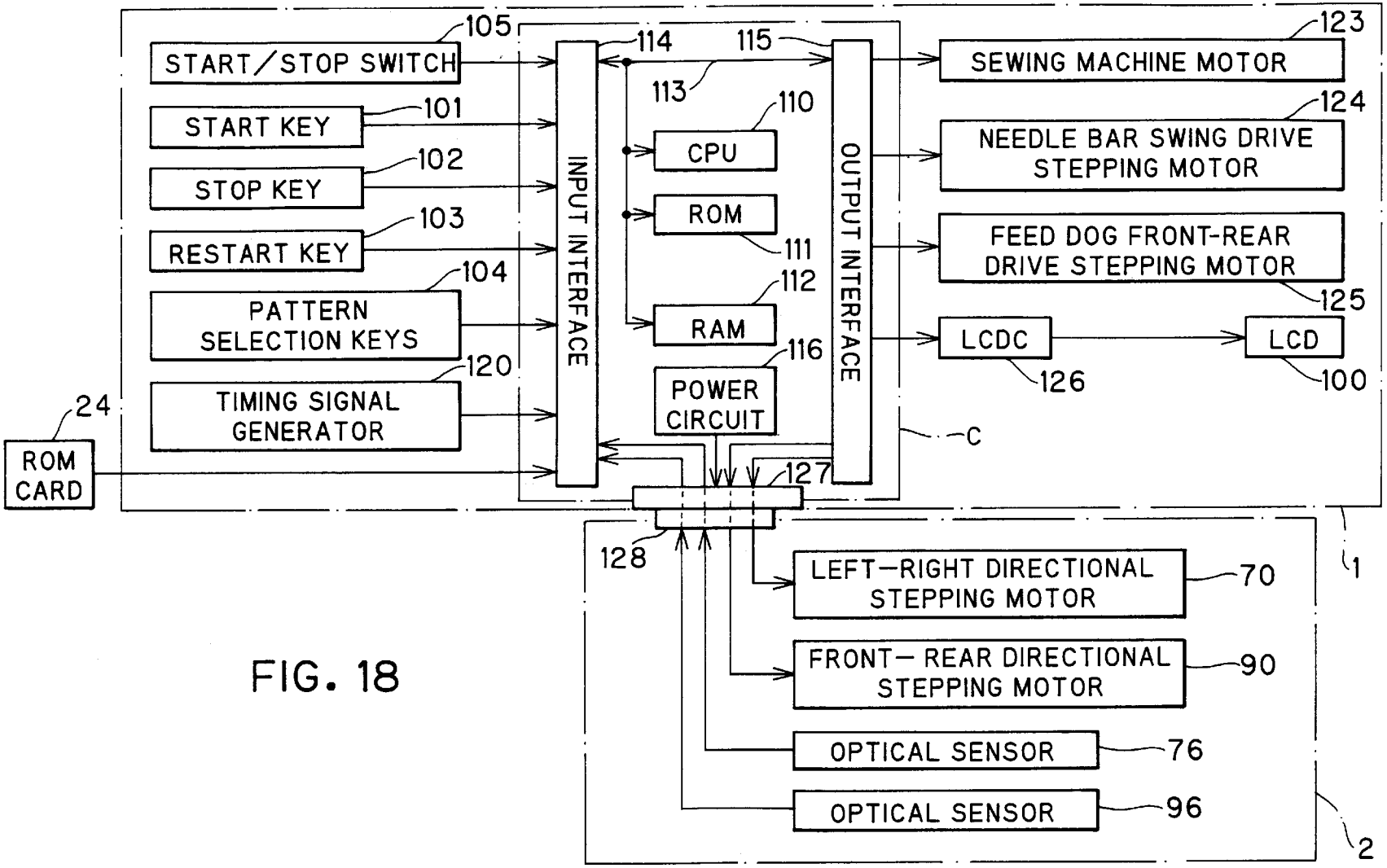
FIG. 18 is a block diagram showing a control system of the sewing machine of FIG. 1.

Although not shown in the drawings, a needle bar drive mechanism and a needle bar swing mechanism are provided for supporting the needle bar 28 and driving the needle bar 28 in the vertical direction and in the left and right ward directions, respectively. Also, other mechanisms, such as a thread take-up lever drive mechanism for driving a thread take-up lever, are provided in the arm portion 5 in addition to the needle bar drive mechanism and the needle bar swing mechanism. As shown in FIGS. 2 and 18, a sewing machine motor 123 is provided in the column portion 4 for driving the feed dog driving mechanism, the needle bar drive mechanism, and the thread take-up lever drive mechanism. As shown in FIG. 2, a transformer 123*a* is provided in the column portion 4 adjacent to the sewing machine motor 123. The transformer 123*a* is for reducing voltage of a power source before power is supplied to circuits of a control system (to be described later) of the sewing machine M. As shown in FIG. 18, a stepping motor 124 is provided for driving the needle bar swing mechanism. A stepping motor 125 is provided for driving the feed dog front-rear drive mechanism.

Next, an explanation will be provided for the sewing machine cover 2. The sewing machine cover 2 includes a cover main body 7 and an extension cover portion 8. As mentioned above, the sewing machine cover 2 houses the left-right embroidery-frame drive mechanism 60 and the front-rear embroidery-frame drive mechanism 80 for independently driving leftward, rightward, forward, and rearward drive of the embroidery frame 50.

Figure 16:
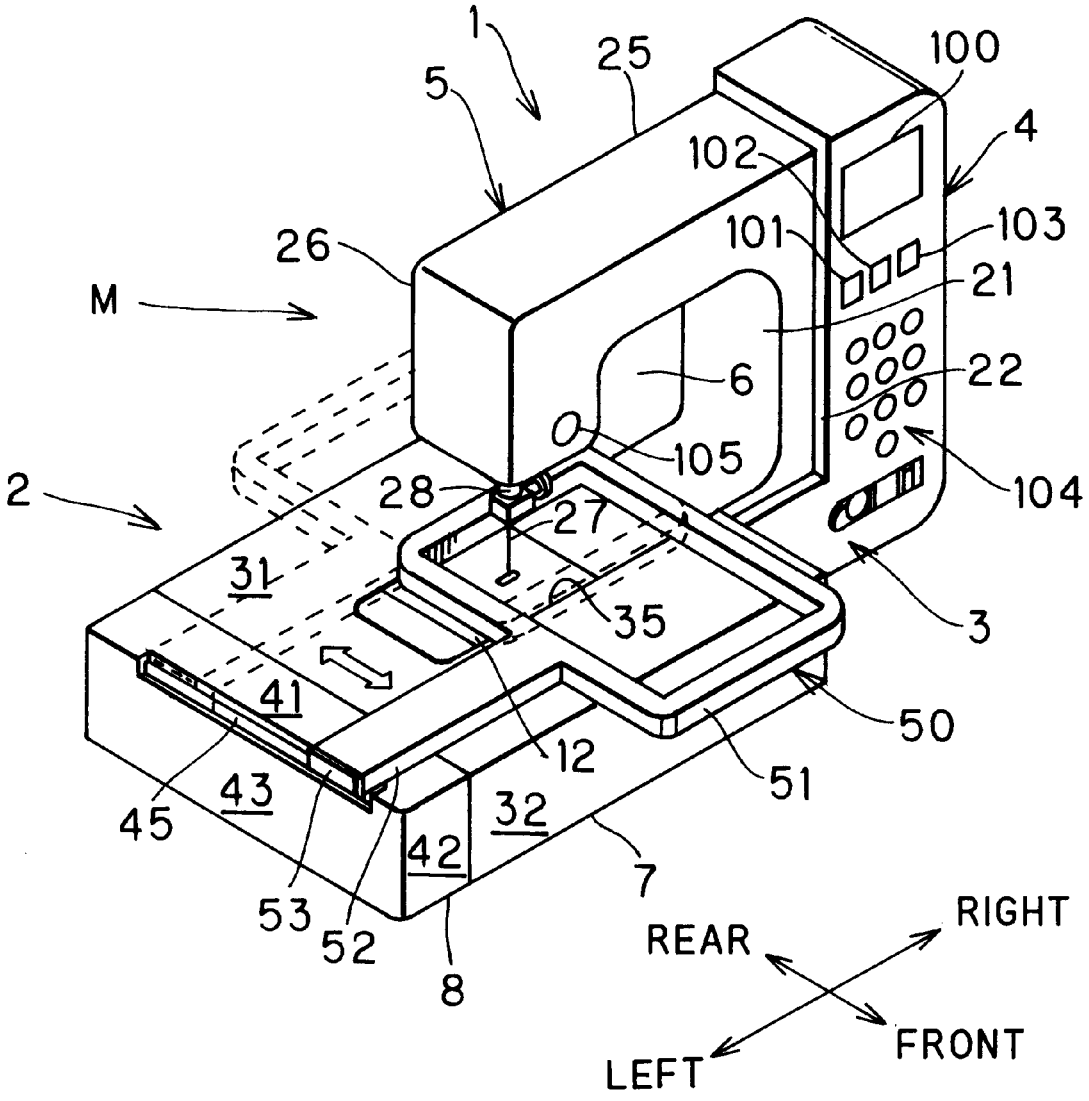
FIG. 16 is a perspective view showing a forwardmost position and a rearwardmost portion of the embroidery frame as driven by a front-rear embroidery-frame drive mechanism of the embroidery-frame drive mechanism.

When the sewing machine cover 2 is used as a cover of the sewing machine M, it covers the front, rear, left, and upper surfaces of the sewing machine M from the vicinity of the engagement portion 11 of the bed portion 3 to the upper surface of the arm portion 5. When the sewing machine cover 2 is used as a supplementary table for the sewing machine M, it adds to the surface area of the bed surface 12 and, as shown in FIGS. 16 and 17, the embroidery-frame drive mechanism 60, 80 can be operated to drive movement of the embroidery frame 50 so that embroidery sewing can be performed on a workpiece cloth supported in the embroidery frame 50.

As shown in FIGS. 1 through 4, the cover main body 7 includes a front wall 30, a rear wall 31, and an upper wall 32 and is opened at its left, right, and lower sides. The walls 30, 31, 32 are formed to a thickness f, which is substantially the same dimension as the height e as the side connecting the step portion 10 to the bed surface 11. The cover main body 7 is formed to a width b between the outer surfaces of the front wall 30 and the rear wall 31. It should be noted that the width B of the cover main body 7 is substantially the same as the sum of the height c of the bed portion 3 and the height e of the step portion 10. An opening 35 is formed near the vertical center of the rear wall 31 to a vertical width g, which is substantially the same dimension as the front to rear width d of the engagement portion 11 so that the opening 35 is engageable with the engagement portion 11 of the bed portion 3.

The extension cover portion 8 includes a front wall 40, a rear wall 41, an upper wall 42, and a left side wall 43 and is opened at its right and lower sides. The extension cover portion 8 is formed dimensions from front to rear and in the vertical direction substantially equal to corresponding dimensions of the cover main body 7 and to a length in the leftward and rightward directions approximately one fifth the length of the arm portion 5. When the sewing machine cover 2 is used as a cover, the right edge surface of the extension cover portion 8 abuts the left edge surface of the cover main body 7. When the sewing machine cover 2 is used as a supplementary table, the outer surface of the rear wall 41 of the extension cover portion 8 forms a portion of the horizontal work surface. A slit 45 is formed in the extension cover portion 8 at the intersectional edge between the rear wall 41 and the left side wall 43. The slit 45 is for insertion of a connection protrusion 53 of the embroidery frame 50 to be described later.

Next, the disposition of the left-right embroidery-frame drive mechanism 60 and the front-rear embroidery-frame drive mechanism 80 in the sewing machine cover 2 will be described with respect to orientation shown in FIG. 2 for the sewing machine cover 2, that is, with respect to orientation when the sewing machine cover 2 is used as a cover for the sewing machine M. The left-right embroidery-frame drive mechanism 60 extends leftward and rightward along the lower edge of the front wall 30 of the cover main body 7 and, as best seen in FIG. 3, is disposed between the arm portion 5 and the bed portion 3 at a position below the opening 35 formed in the rear wall 31. As best seen in FIG. 2, the front-rear embroidery-frame drive mechanism 80 is housed in the extension cover portion 8 so as to extend in the vertical direction above the bed portion 3 and adjacent to the arm portion 5.

Figure 7:
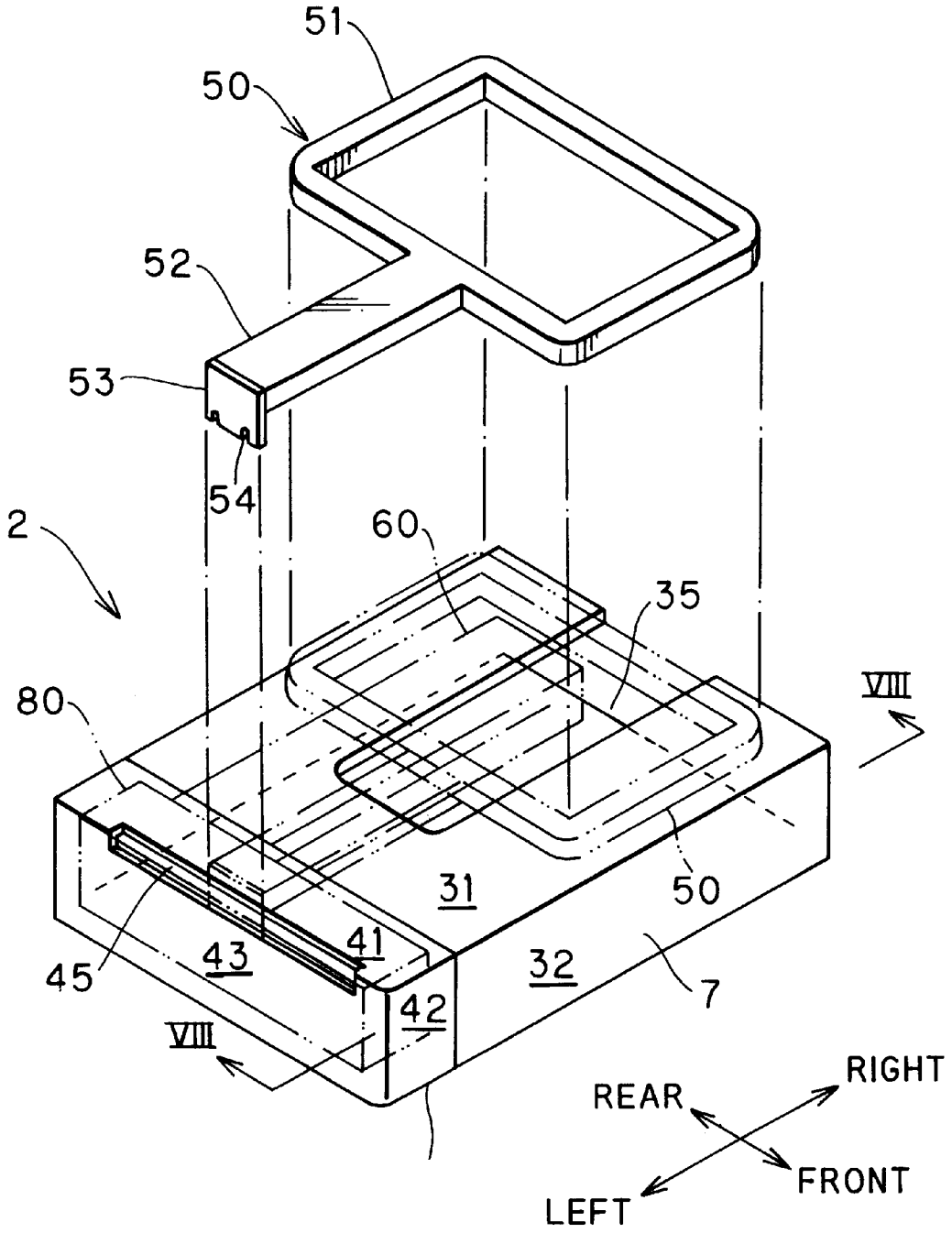
FIG. 7 is a perspective view showing the cover and an embroidery frame attached to the cover when the cover is used as a supplementary table.

Next, an explanation will be provided for the embroidery frame 50 while referring to FIG. 7. The embroidery frame 50 includes a support portion 51 capable of supporting a workpiece cloth in a stretched and taut condition, a bar 52 extending from the support portion 51, and the connection protrusion 53 for insertion in the slit 45 as described above. The connection portion 53 is fixed to the free tip of the bar 52 so as to extend in an orientation perpendicular to the bar 52. The connection portion 53 is formed with connection notches 54 for detachably engaging with a movable frame 82 of the front-rear embroidery-frame drive mechanism 80 in a manner to be described later.

Next, configuration of the left-right embroidery-frame drive mechanism 60 will be described while referring to FIGS. 8 to 12. This explanation, and a subsequent explanation of the front-rear embroidery-frame drive mechanism 80, will be provided with respect to orientation shown in FIG. 6 for the sewing machine cover 2, that is, with respect to orientation when the sewing machine cover 2 is used as a supplementary table.

Figure 9:
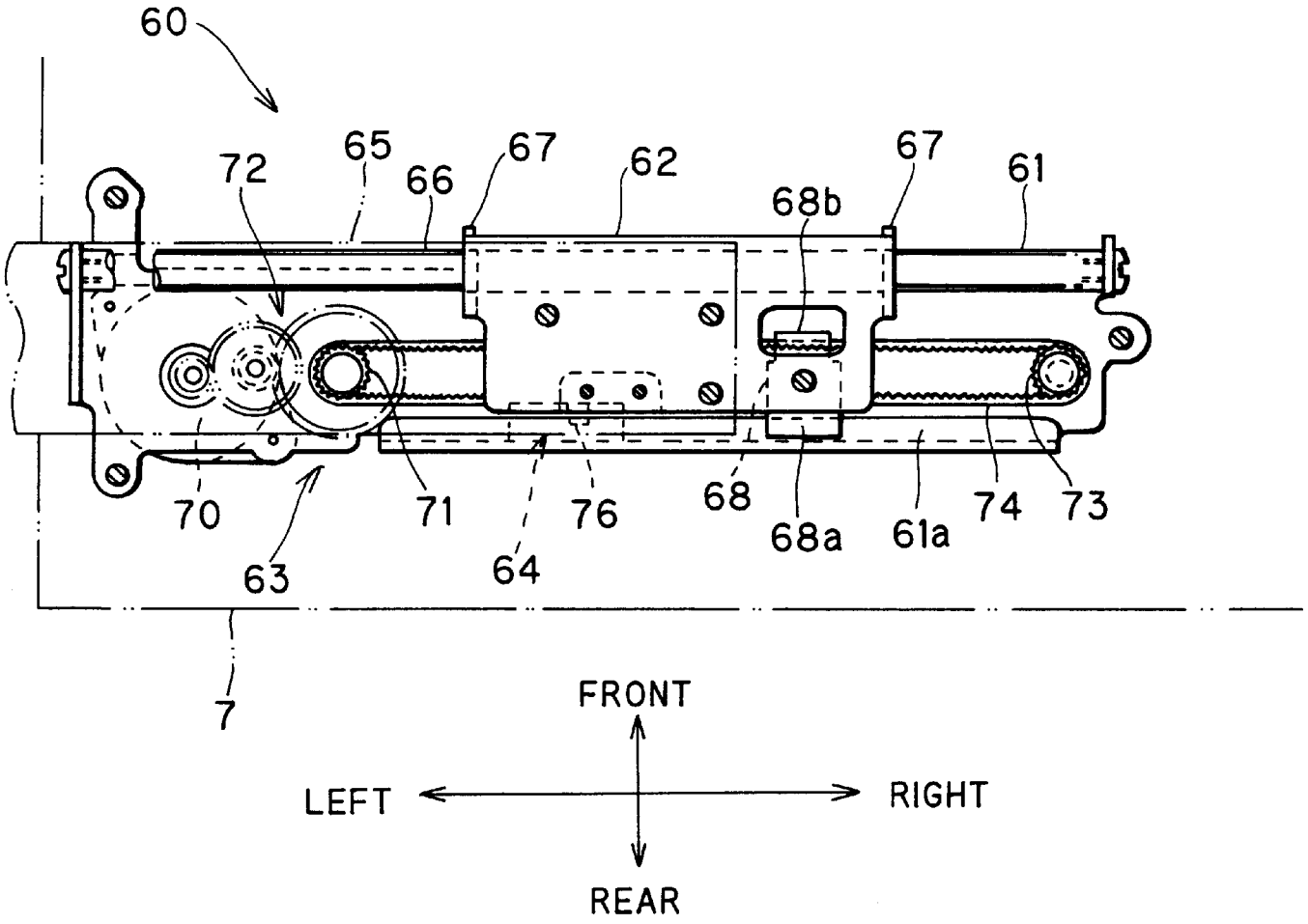
FIG. 9 is cross-sectional view taken along line IX—IX of FIG. 8.
Figure 11:
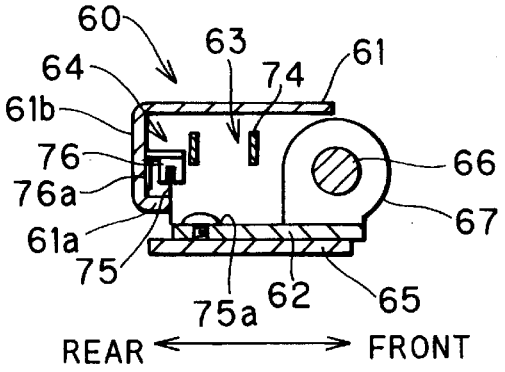
FIG. 11 is cross-sectional view taken along line XI—XI of FIG. 8.
Figure 12:
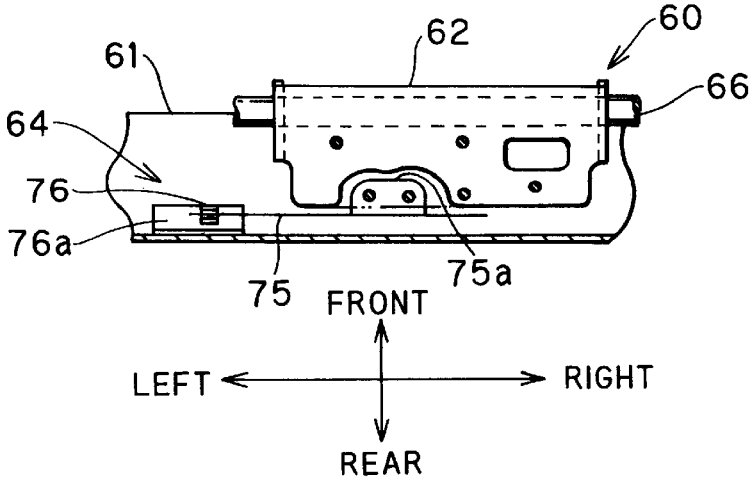
FIG. 12 is a partial view of FIG. 9 with a portion removed to facilitate explanation.

The left-right embroidery-frame drive mechanism 60 includes an elongated support frame 61, a movable frame 62, a drive mechanism 63, and, as shown in FIGS. 9 and 11, a position detection device 64.

Figure 10:
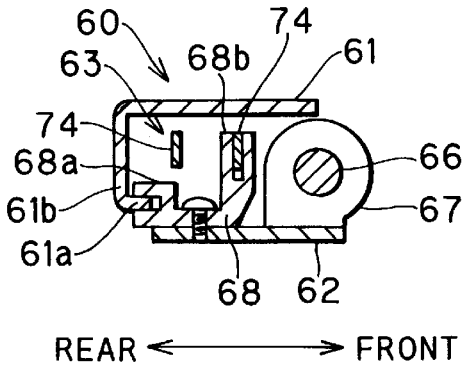
FIG. 10 is cross-sectional view taken along line X—X of FIG. 8.

The support frame 61 is fixed to an inner surface of the cover main body 7 and extends horizontally in the leftward and rightward directions. The support frame 61 has left and right edges 61*x*, 61*y* that support left and right ends 66*x*, 66*y* of a guide rod 66, respectively. As shown in FIG. 10, the support frame 61 is formed at its rear end with a downward bent portion 61*b*. The bent portion 61*b* is formed at its lower edge with a guide rail 61*a* disposed behind the guide rod 66.

The movable frame 62 has a pair of guide portions 67, 67 at its left and right ends and is movably supported at the rear edge of the support frame 61 on the guide rod 66 by the guide portions 67, 67. The guide portions 67, 67 are freely, slidably fitted on the guide rod 66. The movable frame 62 has a connection member 68 attached to its rear edge. As shown in FIG. 10, the connection member 68 has a guide portion 68*a* freely, slidably sandwiching the guide rail 61*a*. With this configuration, the movably frame 62 is supported movable in the leftward and rightward directions. The movable frame 62 is connected to the extension cover 8 by a connection plate 65 so that the extension cover 8 moves in linked association with the movable frame 62.

The drive mechanism 63 is mounted on the support frame 61 and is provided for driving movement of the movable frame 62 as guided by the guide rod 66 in the leftward and rightward directions. The drive mechanism 63 includes a stepping motor 70; a gear mechanism 72 for transmitting drive force of the stepping motor 70; a drive pulley 71 fixed to a gear of the gear mechanism 72; a follower pulley 73; and a timing belt 74 spanning between the drive pulley 71 and the follower pulley 73. As shown in FIG. 10, the timing belt 74 is connected to the connection member 68 of the movable frame 62 via upper edges of a sandwich portion 68*b* of the connection member 68. When the stepping motor 70 rotates, its drive force is transmitted by the gear mechanism 72, the pair of pulleys 71, 73, and the timing belt 74 to drive the movable frame, and also the extension cover portion 8 via the connection plate 65, in the leftward and rightward directions 62.

The stepping motor 70 has a brake mechanism for stopping rotation of the stepping motor 70 when the stepping motor 70 is not energized. The brake mechanism of the stepping motor 70 is for restricting movement of the extension cover portion 8 and the embroidery frame 50 in the leftward and rightward directions when the sewing cover is used as a cover of the sewing machine M. When the sewing machine cover 2 is used as a cover, the brake mechanism stops movement of the extension cover portion 8 in the rightward direction when the right edge surface of the extension cover portion 8 abuts against the left edge surface of the cover main body 7. At this time, the left-right embroidery-frame drive mechanism 60 is positioned in a storage condition. In other words, when the sewing machine cover 2 is used as a cover, the left-right embroidery-frame drive mechanism 60 is stopped in its housing condition by the brake mechanism of the stepping motor 70.

The position detection device 64 is provided for detecting position of the movable frame 62 to determine whether the left-right embroidery-frame drive mechanism 60 is in its storage condition. As best seen in FIG. 11, the position detection device 64 includes an optical sensor 76 and an interruption plate 75. The optical sensor 76 is fixed to the front surface of the bent portion 61*b* via a support member 76*a*. The optical sensor 76 has a light emission portion and a light reception portion sandwiching the interruption plate 75.

The interruption plate 75 is a thin elongated plate extending in the leftward and rightward directions and disposed in an upright posture as viewed in FIG. 11. The interruption plate 75 is formed to a length corresponding to at the least maximum amount that the movable frame 62 can move in the leftward and rightward directions. The interruption plate 75 has a frontward extending attachment plate 75*a* formed by bending a protruding section at the center of the interruption plate 75. The interruption plate 75 is fixed to a rear edge of the upper surface of the movable frame 62 by a screw passing through the attachment plate 75*a*.

The interruption plate 75 is disposed so as to interrupt light emitted from the light emission portion of the optical sensor 76 unless the left-right embroidery-frame drive mechanism 60 is in its storage condition. Said differently, the interruption plate 75 is disposed so as to interrupt light emitted from the light emission portion of the optical sensor 76 when the left-right embroidery-frame drive mechanism 60 is not in its storage condition. In this way, the position detection device 64 can detect that the left-right embroidery-frame drive mechanism 60 is in its storage condition when the optical sensor 76 outputs an ON detection signal.

Next, configuration of the front-rear embroidery-frame drive mechanism 80 will be described while referring to FIGS. 8 and 13 to 15. This explanation of the front-rear embroidery-frame drive mechanism 80 will be provided with respect to orientation shown in FIG. 6 for the sewing machine cover 2, that is, with respect to orientation when the sewing machine cover 2 is used as a supplementary table.

Figure 13:
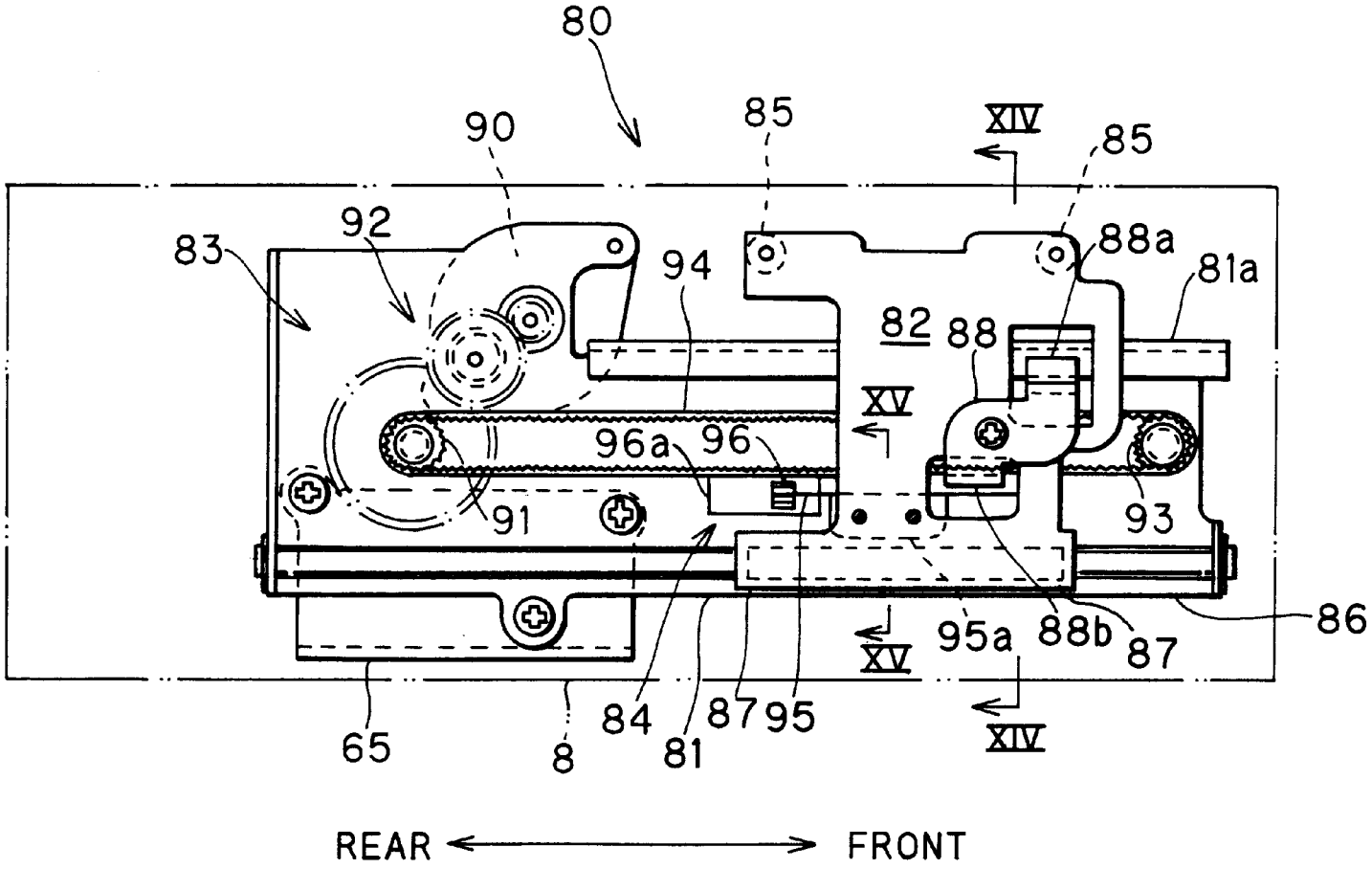
FIG. 13 is cross-sectional view taken along line XIII—XIII of FIG. 8.

As best shown in FIG. 13, the front-rear embroidery-frame drive mechanism 80 includes a support frame 81, a movable frame 82, a drive mechanism 83, and a position detection device 84. The support frame 81 extends in the front and rear directions and includes at its upper edge a bent portion 81*b* that bends to the left and a guide rail 81*a* formed to the left edge of the bent portion 81*b*. A guide rod 86 is supported below the guide rail 81*a* at front and rear ends of the support frame 81. As best seen in FIG. 8, the support frame 81 is fixed to the connection plate 65 extending from the movable frame 62 of the left-right embroidery-frame drive mechanism 60. Although not shown in the drawings, the support frame 81 is also fixed to the inner surface of the extension cover portion 8. With this configuration, front-rear embroidery-frame drive mechanism 80 and the extension cover portion 8 move in association with movement of the movable frame 62 of the left-right embroidery-frame drive mechanism 60.

Figure 14:
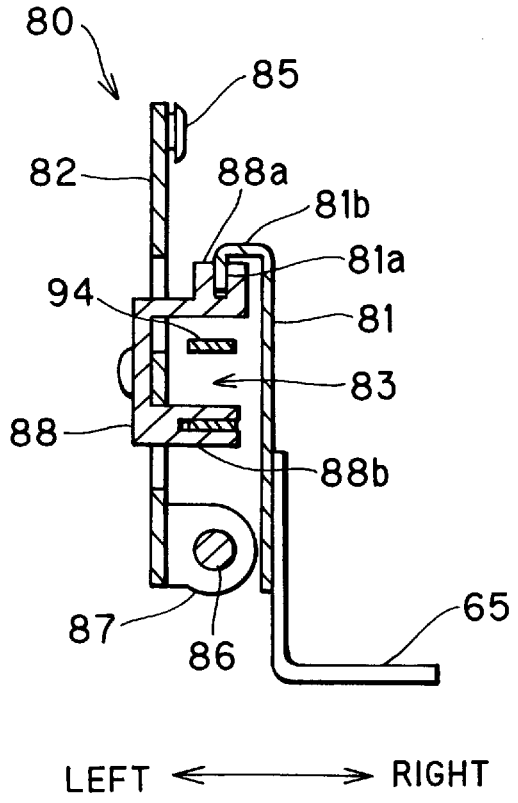
FIG. 14 is cross-sectional view taken along line XIV—XIV of FIG. 13.

As best seen in FIG. 13, the movable frame 82 has at its front and rear ends a pair of guide portions 87 that are freely, slidably disposed on the guide rod 86. As best seen in FIG. 14, the movable frame 82 is attached to a connection member 88. The connection member 88 has at its upper right edge a guide portion 88*a* that freely, slidably sandwiches the guide rail 81*a*. With this configuration, the movable frame 82 is supported movable in the front and rear directions on the left side of the support frame 81. Movement of the support frame 81 in the front and rear directions is guided by the guide rod 86 and the guide portions 87 and by the guide rail 81*a* and the guide portion 88*a*.

A pair of front and rear connection pins 85 protrude to the right from the upper edge of the movable frame 82. The connection notches 54 of the embroidery frame 50 are detachably connectable to the connection pins 85. When the sewing machine cover 2 serves as a supplementary table, the connection portion 53 is inserted in the slit 45 of the extension cover portion 8 and the connection notches 54 are engaged with the connection pin 85. As a result, the lower surfaces of the support portion 51 and the bar 52 of the embroidery frame 50 are supported in slidable contact with the rear walls 31, 41.

The drive mechanism 83 is mounted on the support frame 81 and is provided for driving movement of the movable frame 82 and the embroidery frame 50 in the front and rear directions. The drive mechanism 83 includes a stepping motor 90; a gear mechanism 92 for transmitting drive force of the stepping motor 90; a drive pulley 91 fixed to a gear of the gear mechanism 92; a follower pulley 93; and a timing belt 94 spanning between the drive pulley 91 and the follower pulley 93. The timing belt 94 is fixed to a sandwich portion 88*b* attached to a lower right edge of the connection member 88. When the stepping motor 90 rotates, its drive force is transmitted by the gear mechanism 92, the pulleys 91, 93, and the timing belt 94 to drive in the front and rear directions the movable frame 82, and consequently the embroidery frame 50.

The stepping motor 90 includes a brake mechanism for stopping rotation of the stepping motor 90 when the stepping motor 90 is not energized. The brake mechanism of the stepping motor 90 is for restricting movement of the movable frame 82 and the embroidery frame 50 in the front and rear directions when the sewing machine cover 2 is used as a cover of the sewing machine M. When the sewing machine cover 2 is used as a cover of the sewing machine M, the movable frame 82 is positioned near the front edge of the support frame 81 and, as shown in FIG. 16, the connection protrusion 53 of the embroidery frame 50 is positioned at the front edge of the slit 45. In this case, the front-rear embroidery-frame drive mechanism 80 is in a storage condition.

Figure 15:
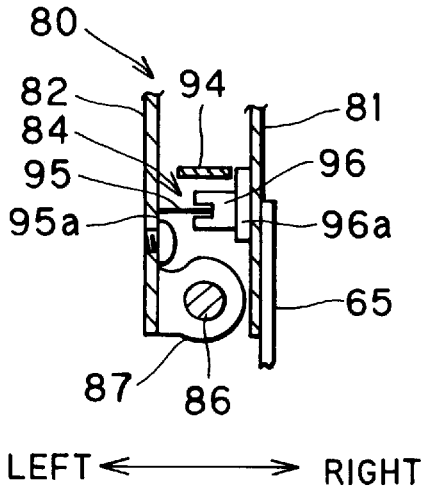
FIG. 15 is cross-sectional view taken along line XV—XV of FIG. 13.

The position detection device 84 is provided for detecting position of the movable frame 82 to determine whether the front-rear embroidery-frame drive mechanism 80 is in its storage condition. The position detection device 84 includes an optical sensor 96 and an interruption plate 95. As best seen in FIG. 15, the optical sensor 96 is attached to the left side of the support frame 81 via a support member 96*a*. The optical sensor 96 includes light emission and light reception portions sandwiching the interruption plate 95.

The interruption plate 95 is a thin elongated plate extending in the front end rear directions to a length corresponding to at least the maximum amount that the gear mechanism 92 can move in the front and rear directions. The interruption plate 95 is disposed in a reclining posture as viewed in FIG. 15. The interruption plate 95 has a downward extending attachment plate 95*a* formed by bending a protruding section at the center of the interruption plate 95. The interruption plate 95 is fixed to the lower right surface of the movable frame 82 via a screw passing through the attachment frame 95*a*.

The interruption plate 95 is disposed so as to interrupt light emitted from the light emission portion of the optical sensor 96, so that the optical sensor 96 outputs an OFF detection signal, unless the front-rear embroidery-frame drive mechanism 80 is in its storage condition. On the other hand, when the front-rear embroidery-frame drive mechanism 80 is positioned in its storage condition, the interruption plate 95 will not interrupt the light emitted from the light reception portion of the optical sensor 96 so that the optical sensor 96 will output an ON detection signal. Therefore, the position detection device 84 can detect when the front-rear embroidery-frame drive mechanism 80 is in its storage condition when the optical sensor 96 outputs an ON detection signal.

Next, the control system of the sewing machine M will be described while referring to FIG. 18. The control system of the sewing machine M includes a control device C. The control device C includes a CPU 110 and a variety of components connected to the CPU 110 via a bus 113, such as a data bus. For example, the CPU 110 is connected to an input interface 114, an output interface 115, a ROM 111, and a RAM 112.

The input interface 114 is connected to the start/stop switch 105, the start key 101, the stop key 102, the restart key 103, the pattern selection keys 104, and a timing signal generator 120. Additionally, the input interface 114 is brought into electrical connection with the optical sensors 76, 96 in the sewing machine cover 2 by the connectors 127, 128 when the sewing machine cover 2 is used as a supplementary table for the sewing machine M. The input interface 114 is brought into connection with a ROM card 24 when the ROM card 24 is mounted in the card slot 24*a*. It should be noted that the timing signal generator 120 is provided in the vicinity of the sewing machine principal shaft rotated by the sewing machine motor 123 and is for generating a variety of timing signals for controlling, for example, upper and lower positions of the needle.

The output interface 115 is connected to the sewing machine motor 123, the stepping motor 124, the stepping motor 125, and a display controller (LCDC) 126 for controlling the liquid crystal display 100. Additionally, the output interface 115 is brought into electrical connection with the stepping motors 70, 90 of the sewing machine cover 2 via the connectors 127, 128 when the sewing machine cover 2 is used as a supplementary table for the sewing machine M.

A power circuit 116 is provided for supplying power to electrical components in the sewing machine cover 2. The power circuit 116 is brought into electrical connection with, for example, the left-right embroidery-frame drive mechanism 60 and the front-rear embroidery-frame drive mechanism 80 in the sewing machine cover 2 by the connectors 127, 128 when the sewing machine cover 2 is used as a supplementary table for the sewing machine M.

The ROM 111 of the control device C stores data on a plurality of embroidery patterns and a variety of programs, such as a program for controlling drive of the motors 123 to 125, 70, 90, a program for controlling storage of the embroidery-frame drive mechanisms, a program for editing embroidery patterns, and a program for preparing stitch data.

The RAM 112 includes a variety of pointers, counters, flag memories, and buffers needed for performing the above-described control processes and a variety of memories for temporarily storing computation results computed by processes of the CPU 110.

Next, an explanation will be provided for processes performed to control storage of the embroidery-frame drive mechanisms 60, 80. When embroidery sewing is completed or interrupted while the sewing machine cover 2 is used as a supplementary table for the sewing machine M, the embroidery-frame drive mechanisms 60, 80 are driven to stop in their respective storage conditions by the stepping motors 70, 90 as controlled by the control device C and the position detection devices 64, 84.

Embroidery sewing of an edited embroidery pattern is started by setting the start key 101 to an ON position. Embroidery sewing is interrupted by setting the stop key 102 to its ON position. When embroidery sewing is completed or interrupted, as indicated when an embroidery pattern is completed or an interruption command is inputted via the stop key 102, an embroidery-frame drive mechanism storage program is executed in the control device C. This program stops output of the drive signals to the sewing machine motor 123 and the like and starts output of drive signals to the stepping motors 70, 90 to drive the embroidery-frame drive mechanisms 60, 80 toward their respective storage conditions. The movable frames 62, 82 are moved until the optical sensors 76, 96 output ON detections signals, whereupon output of drive signals to the stepping motors 70, 90 is stopped and the embroidery-frame drive mechanisms 60, 80 are stopped in their respective storage conditions.

Next, a brief explanation will be provided for a method for editing embroidery patterns. The ROM 111 of the control device C stores pattern data for a plurality of patterns, such as different animals and transportation devices; embroidery frame pattern data on a plurality of embroidery frames, such as curved lines and arches; and character pattern data on a plurality of characters, such as alphanumeric characters and Japanese hiragana, katakana, and kanji. The ROM card 24 stores a variety of pattern data other than pattern data stored in the ROM 111 of the control device C.

To retrieve pattern data from the ROM 111 or the ROM card 24, the user turns on power of the sewing machine M and manipulates predetermined keys of the pattern selection keys 104 to input a number for selecting a desired pattern stored in the ROM 111 or the ROM card 24. As a result, pattern data corresponding to the inputted number is retrieved from the ROM 111 or the ROM card 24 and is stored in the RAM 112. The pattern is then displayed at a predetermined position in a predetermined size on the liquid crystal display 100. At this time, data indicating size and initial position of the selected pattern with respect to an embroiderable region of the sewing machine M is also stored in the RAM 112.

Next, the user can change size or position of the selected pattern with respect to the embroiderable region of the sewing machine M by manipulating predetermined keys of the pattern selection keys 104. If the user changes size or position of the selected pattern in this way, data on the size and position of the selected pattern is changed accordingly and updated in the RAM 112. When the user selected more than one pattern, pattern data including the initial positions and sizes of selected patterns is stored in the RAM 112. Next, a program for preparing composite pattern data is performed so the selected embroidery patterns can be edited. One method for editing embroidery patterns is shown, for example, in U.S. Pat. No. 5,355,319, the disclosure of which is hereby incorporated by reference.

Afterward, when the start key 101 is turned on, stitch data is prepared based on the pattern data stored in the RAM 112. Then, the sewing machine motor 123 is driven based on the stitch data to drive the sewing needle 27. The stepping motors 70, 90 are driven based on the stitch data in synchronization with the vertical movement of the sewing needle 27 to move the embroidery frame 50 with respect to the sewing needle 27. As a result, embroidery sewing is performed on a workpiece cloth supported in the embroidery frame 50.

Next, an explanation will be provided for the sewing machine cover 2 when used as a cover of the sewing machine M and as a supplementary table for the sewing machine M.

Figure 4:
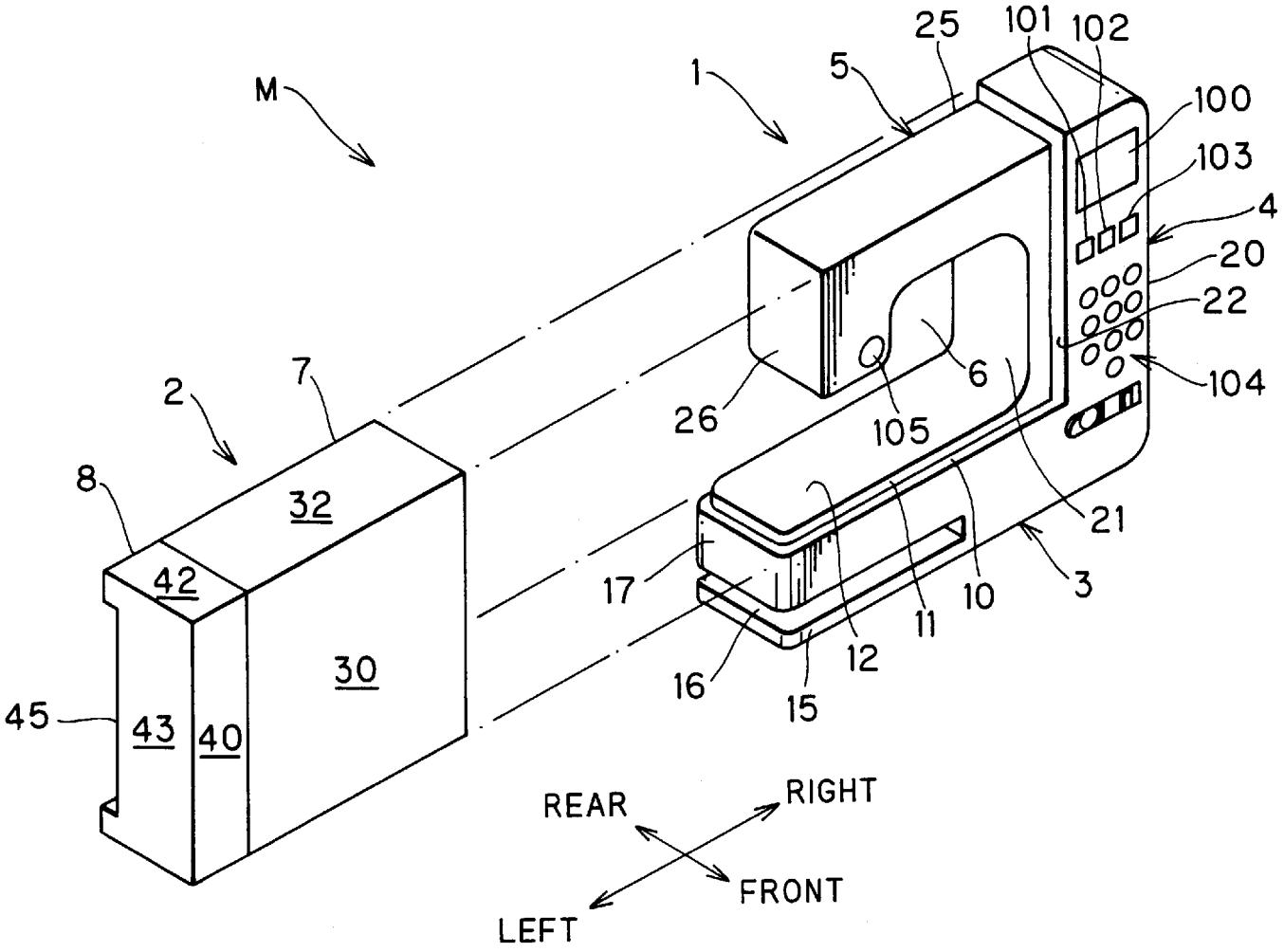
FIG. 4 is a perspective view showing the sewing machine with the cover in a detached condition.

First, an explanation will be provided for when the sewing machine cover 2 is used as a cover of the sewing machine M. To mount the sewing machine cover 2 on the frame 1 of the sewing machine M, first, as shown in FIG. 4, the sewing machine cover 2 is oriented with the front and rear walls 30, 31 in an upright posture and the right edge facing the column portion 4. From this condition, the sewing machine cover 2 is moved toward the column portion 4 until the lower left and right edges of the sewing machine cove 2 are aligned with the step portion 10. Further movement of the sewing machine cover 2 is guided by contact between the left and right edges of the sewing machine cover 2 and the step portion 10 and between the inner surface near the left and right edges of the sewing machine cover 2 and the front and rear surfaces of the engagement portion 11 of the bed portion 3. The sewing machine cover 2 is moved in the rightward direction until the right edge of the sewing machine cover 2 abuts against the abutment surface 22 of the column portion 4, whereupon, as shown in FIGS. 1 through 3, the sewing machine cover 2 completely covers the bed surface 12 of the bed portion 3 and the upper surface of the arm portion 5 and partially covers the front, rear, and left surfaces of the arm portion 5.

When the sewing machine cover 2 is mounted on the sewing machine M and is used as a cover, the left-right embroidery-frame drive mechanism 60 is stored between the bed portion 3 and the arm portion 5 near the inner surface of the front wall 30 of the cover main body 7 so will not contact components such as the bed portion 3, the arm portion 5, the needle bar 28, and the sewing needle 27. Further, in this condition the sewing machine cover 2 protects the bed surface 12, components disposed in the space 6, such as the sewing needle 27 and the needle bar 28, the arm portion 5, and components disposed at the front surface of the column portion 4, such as keys and switches like the start/stop switch 105.

Furthermore, the sewing machine M will have a compact and orderly parallelepiped shape, and so is convenient to carry or store away in a closet. When the user wishes to carry the sewing machine M, he or she can do so by grasping the bed portion 3 through the opening 35 of the sewing machine cover 2. At this time, the sewing machine M has good weight balance and is easy to carry because the left-right stepping motor 70, the front-rear stepping motor 90, the sewing machine motor 123, and the transformer 123*a* are positioned for this purpose. That is, the weight of the left-right stepping motor 70 and the front-rear stepping motor 90 are in balance with weight and position of the sewing machine motor 123 and the transformer 123*a*.

Next, an explanation will be provided for when the sewing machine cover 2 is used as a supplementary table. To mount the sewing machine cover 2 on the frame 1 to use the sewing machine cover 2 as a supplementary table, as shown in FIG. 7, the sewing machine cover 2 is laid on its side so that the opening 35 faces upward and the front and rear walls 30, 31 are in a horizontal orientation. Then the rear wall 31 is aligned with the bed portion 3 so that the front and rear surfaces that define the opening 35 are aligned with the front and rear surfaces of the engagement portion 11 and inner surfaces adjacent to the opening 35 are aligned with the step portion 10. The sewing machine cover 2 is then moved in the rightward direction as guided by contact between the rear wall 31 and the bed portion 3 until the rightward facing edge defining the opening 35 abuts the leftward facing surface of the engagement portion 11. When surfaces of the rear wall 31 defining the opening 35 engage with surfaces of the engagement portion 11, then as shown in FIGS. 5 and 6, the sewing machine cover 2 is in an condition where it can be used as a supplementary table.

When the opening 35 is engaged with the engagement portion 11, most of the bed portion 3 is housed within the sewing machine cover 2. Also, the bed surface 12 of the engagement portion 11 and the outer surface of the rear wall 31, which in this condition is the upper surface of the supplementary table, together form a consecutive flush working surface, which has a greater surface area than the area of the bed surface 12 alone. The lower surface of the base portion 15 is mounted on the front wall 30 of the sewing machine cover 2 so that the sewing machine cover 2 is securely fixed in place by weight of the bed portion 3.

To increase stableness of the sewing machine M when the sewing machine cover 2 is used as a supplementary table in this manner, as shown in FIG. 6, one or more retractable support legs 1000 can be provided to the lower surface of the right end of the bed portion 3. The support legs 1000 can be housed within the bed portion 3 when the sewing machine cover 2 is used as a cover and extended downward in the vertical direction to stabilize the sewing machine M when the sewing machine cover 2 is used as a supplementary table.

Alternatively, the bed portion 3 can be formed so that its right side protrudes lower than its left side by an amount equal to the thickness f of the walls of the sewing machine cover 2. In this case, a retractable leg or legs can be provided to the underside of the left end of the bed portion 3. The leg or legs can be urged downward by a force sufficient to support the frame 1. In this case, when the sewing machine cover 2 is used as a cover, the leg or legs will be extended downward so that the left and right undersides of the bed portion 3 are flush with each other. On the other hand, when the sewing machine cover 2 is used as a supplementary table, the leg or legs can be retracted in so that the sewing machine cover 2 can be fitted on the bed portion 3 and the right side of the bed portion 3 is flush with the downward facing sewing machine cover surface.

As a further alternative, the bed portion and the sewing machine cover can be formed so that the entire lower surface of bed portion is housed within the sewing machine cover when the sewing machine cover is used as a support table.

However, the lower surface of the base portion 15 need not be mounted on the front wall 30 of the sewing machine cover 2 when the sewing machine cover 2 is used as a supplementary table. Instead, the front wall 30 can be formed to extend into and engage with the lower surface of the free arm portion 17 when the sewing machine cover 2 is used as a supplementary table. In this case, the sewing machine cover 2 is not used as a supplementary table when the free arm portion 17 is used for sewing on bags and cylindrical objects, such as shirt sleeves and pants legs because otherwise the sewing machine cover 2 would interfere with sewing operations.

To perform embroidery sewing while the sewing machine cover 2 is used as a supplementary table, the connection protrusion 53 of the embroidery frame 50 is inserted in the slit 45 of the extension cover portion 8 and the connection notches 54 of the connection protrusion 53 are engaged with the connection pins 85 of the movable frame 82. Because engagement between the notches 54 and the connection pins 85 securely holds the frame 50 to the movement mechanism 80, the left-right embroidery-frame drive mechanism 60 and the front-rear embroidery-frame drive mechanism 80 can independently drive, in the left, right, front, and rear directions, the embroidery frame 50 across the working space formed from the bed surface 12 and the sewing machine cover 2. Because the connection pins 85 are housed within the sewing machine cover 2, they will not interfere with engagement between the sewing machine cover 2 and the bed portion 3 and will not interfere with normal sewing operations.

The sewing machine M has the ability to perform both normal sewing and also embroidery sewing. Because the embroidery-frame drive mechanisms are housed within the sewing machine cover 2, the sewing machine M has an extremely compact shape when the sewing machine M is not being used and the sewing machine cover 2 is used as a cover, and so can be conveniently carried and stored away in a closet.

Further, the sewing machine cover can be used as a supplementary table during both normal sewing and embroidery sewing. That is, the sewing machine cover 2 forms a broad working surface during normal sewing and a large movement area for the embroidery frame 50 to move around in during embroidery sewing.

Because the embroidery-frame drive mechanisms are housed within the sewing machine cover 2, there is no need to provide a device including embroidery-frame drive mechanism for the embroidery frame separately from the sewing machine cover. As a result, the sewing machine M according to the present embodiment is less expensive to provide and has much fewer components than conventional sewing machines capable of performing both normal sewing and embroidery sewing.

While the invention has been described in detail with reference to specific embodiments thereof, it would be apparent to those skilled in the art that various changes and modifications may be made therein without departing from the spirit of the invention, the scope of which is defined by the attached claims.

In the above-described embodiment, the start/stop switch 105 is used to indicate when normal sewing is to be performed and the start key 101 and the stop key 102 are used to indicate embroidery sewing is to be performed. That is, the sewing machine M determines that operation of the start/stop switch 105 on and off relates to normal sewing performed using the feed dog. On the other hand, the sewing machine determines that operation of the start key 101 and the stop key 102 relates to embroidery sewing performed with a workpiece cloth supported by the embroidery frame 50.

However, a single common key can be provided for turning on and off both normal sewing and embroidery sewing. In this case, to enable the CPU of the sewing machine M to distinguish between whether normal sewing, wherein the sewing machine cover 2 is used as a supplementary table for a workpiece cloth, or embroidery sewing, wherein the sewing machine cover 2 is used as a movement surface for the embroidery frame 50, is to be performed, a sensor can be provided to determine when the embroidery frame 50 is mounted in the slot 45 or when an external memory, such as the ROM card 24, is mounted in the card slot 24*a*. Alternatively, other components, which are positioned differently during normal sewing and during embroidery sewing, can be detected to determine whether normal sewing or embroidery sewing is to be performed.

The present embodiment described the present invention applied to a sewing machine M designed for a right handed user. In this case, the column portion 4 is disposed on the right and the arm portion 5 extends leftward from the column portion 4. However, the present invention could be applied to a sewing machine for a left handed user. In this case, the column portion is disposed on the left and the arm portion extends rightward from the column portion.

Also, the transformer 123*a* need not be provided when the sewing machine does not have a control system such as a computer.

Further, a handle can be provided to the upper surface of the arm portion 5. In this case, it is desirable that a hole through which the handle can pass be formed in the upper surface of the sewing machine cover. With this configuration, the handle which protrudes through the hole can be used to carry the sewing machine while the sewing machine cover is used as a cover.

Next, three different modifications of the embodiment will be described while referring FIGS. 19 through 23, wherein like components are indicated by the same numbers to avoid duplicating description.

Figure 19:
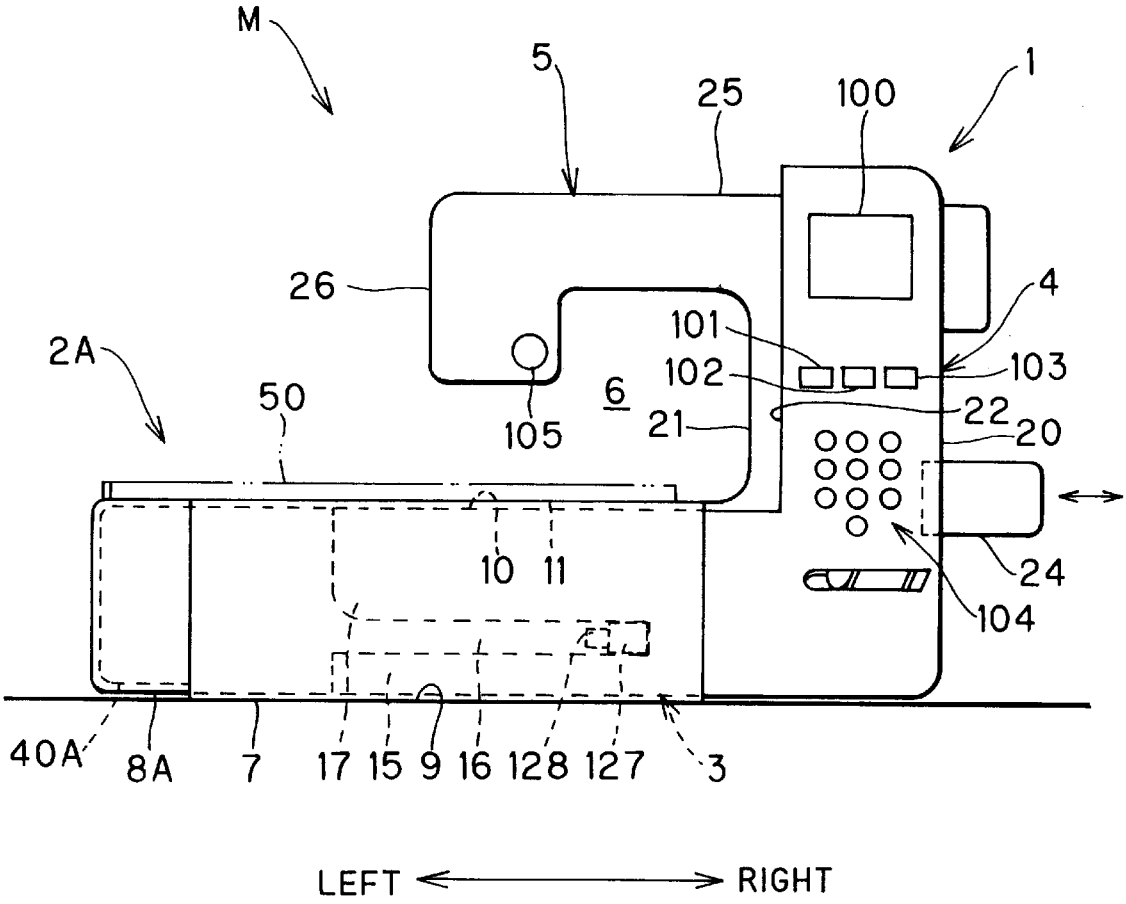
FIG. 19 is a front view showing a sewing machine according to a first modification of the embodiment of the present invention.
Figure 20:
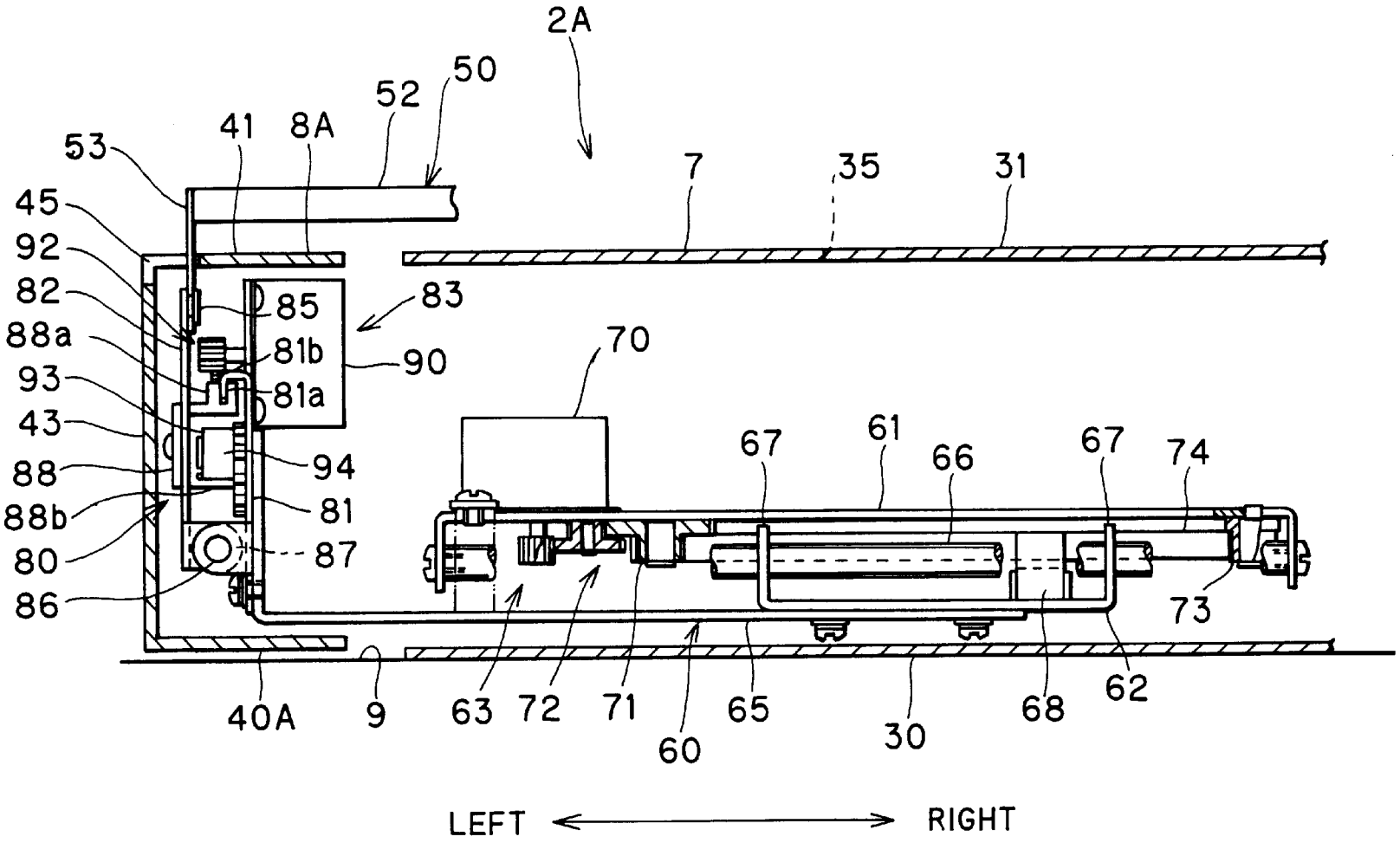
FIG. 20 is a cross-sectional view showing embroidery-frame drive mechanism of the sewing machine of FIG. 19.

A first modification will be described while referring FIGS. 19 and 20. The sewing machine M of the first modification includes a sewing machine cover 2A having an extension cover portion 8A in place of the extension cover portion 8 of the embodiment. The extension cover portion 8A is formed so that when the sewing machine cover 2A is used as a supplementary table, the front wall 40A extension cover portion 8A is positioned higher than the front wall 30 of the cover main body 7. With this configuration, when the sewing machine M is placed on a desk or floor surface and the sewing machine cover 2A is used as a supplementary table, the lower surface of the extension cover portion 8A will not contact an upper surface 9 of the desk or floor. Therefore, the extension cover portion 8A can be smoothly driven leftward and rightward by the left-right embroidery-frame drive mechanism 60. This is particularly beneficial when the sewing machine M is used placed on a material having a great friction coefficient, such as a table cloth or a carpet.

Figure 21:
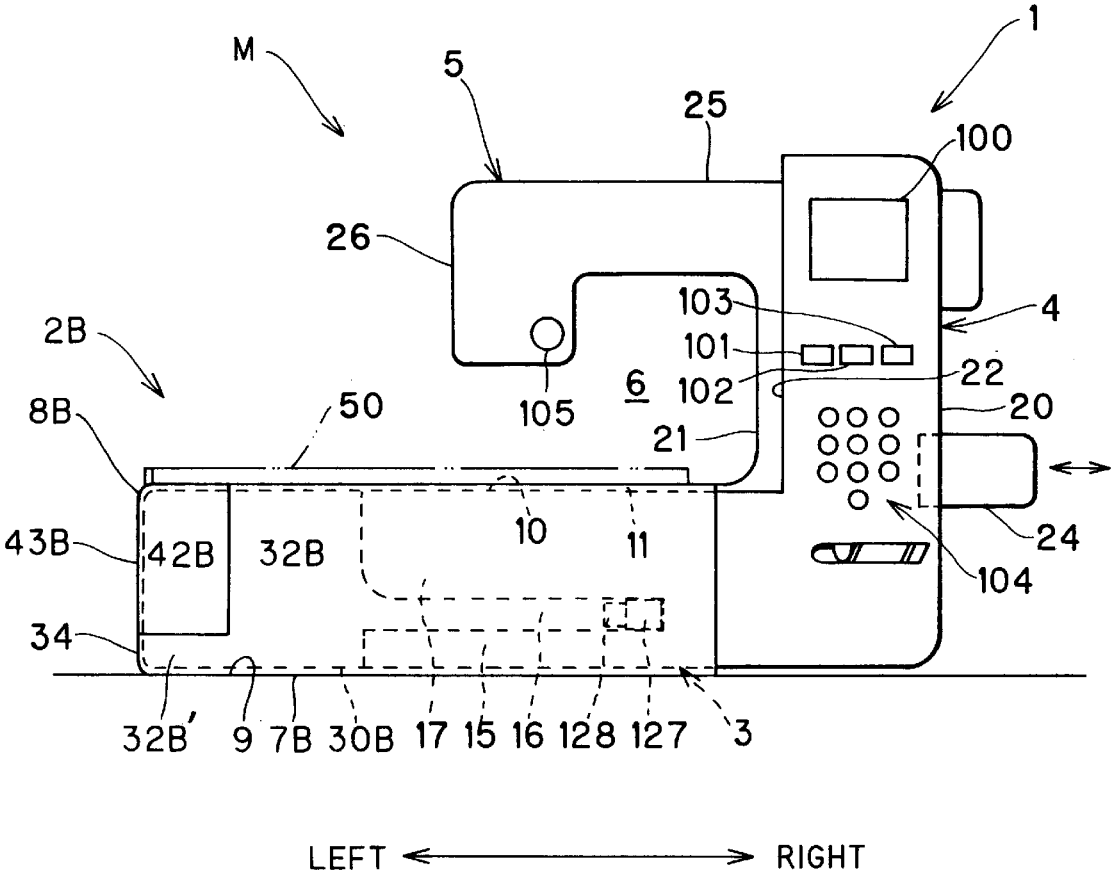
FIG. 21 is a front view showing a sewing machine according to a second modification of the embodiment.
Figure 22:
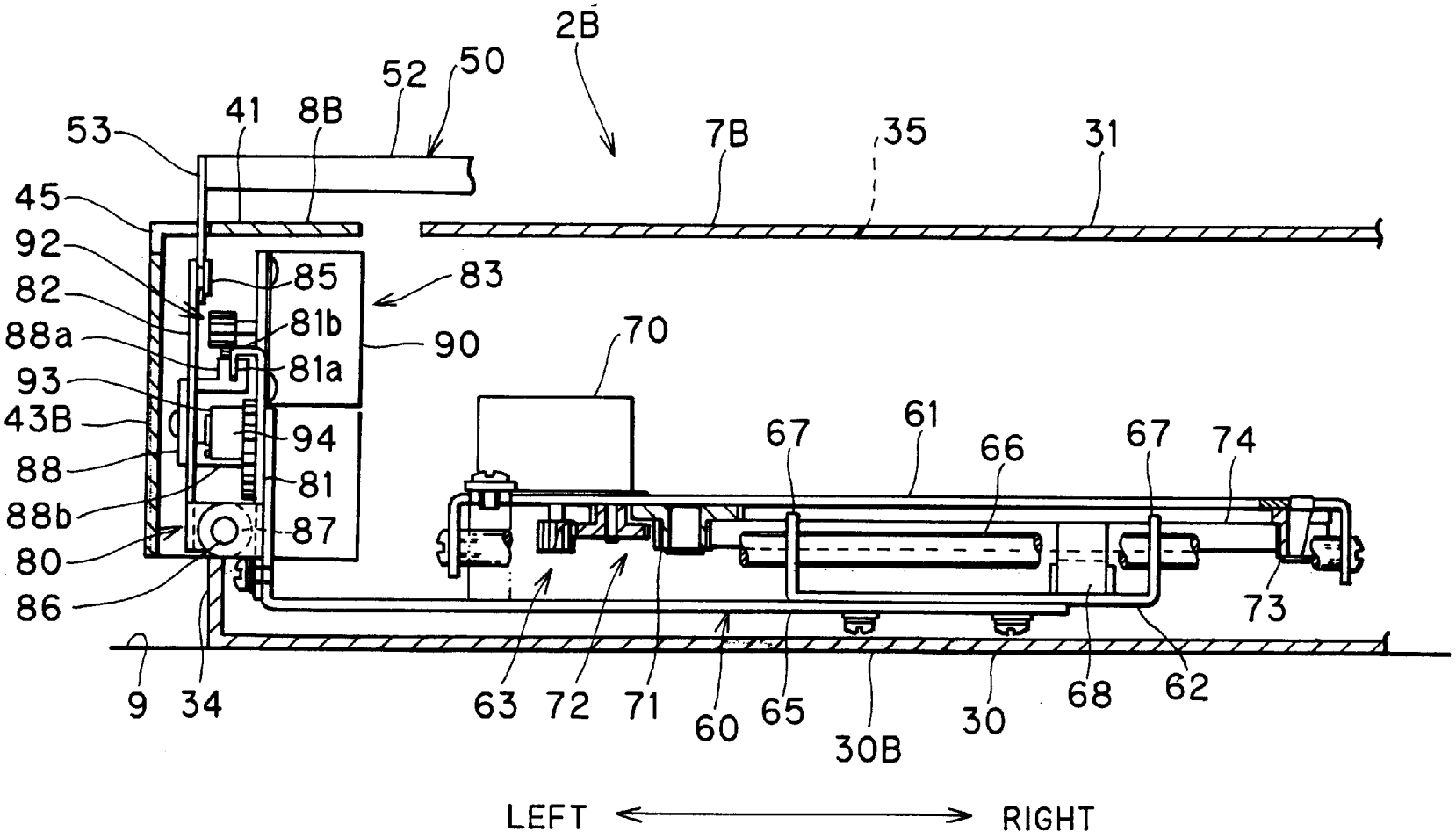
FIG. 22 is a cross-sectional view showing embroidery-frame drive mechanisms of the sewing machine of FIG. 21.

Next, a second modification will be described while referring FIGS. 21 and 22. The sewing machine M according to the second modification has a cover 2B with a cover main body 7B and an extension cover portion 42B instead of the cover main body 7 and the extension cover portion 8 of the embodiment. The cover main body 7B includes a front wall 30B, an upper wall 32B having a leftward protruding portion 32B', and a left wall 34 in connection with the leftward protruding portion 32B'.

The cover 2B will be described with respect to the orientation of the cover 2B when used as a supplementary table. The front wall 30B faces downward and extends in the leftward and rightward directions, the upper wall 32B faces frontward and extends in the leftward and rightward directions, and the left wall 34 faces leftward and extends in the front and rear directions. The left wall 34 extends vertically from the left edge of the front wall 30B to the upper edge of the leftward protruding portion 32B' and is formed to the same height as the leftward protruding portion 32B'.

The extension cover portion 8B has an upper wall 42B and a left side wall 43B. The extension cover portion 8B is disposed above the wall 34 and the leftward protruding portion 32B'. The lower surfaces of the extension cover portion 8B, that is, the lower surfaces of the left side wall 43B and the upper wall 42B, are configured to slide across the upper surfaces of the wall 24 and the leftward protruding portion 32B' of the cover main body 7B.

With this configuration, when the sewing machine M is mounted on a table top or floor, for example, and the sewing machine cover 2B is used as a supplementary table, the extension cover portion 8B will not contact the surface 9 of the table top, for example, so that the extension cover portion 8B can be smoothly driven in the leftward and rightward directions by the left-right embroidery-frame drive mechanism 60. Further, even if downward pressing force is applied on the extension cover portion 8B from above, the cover main body 7B will support the extension cover portion 8B so that the left-right embroidery-frame drive mechanism 60 and the front-rear embroidery-frame drive mechanism 80 will not be damaged by vertical movement transmitted by the connection plate 65.

Figure 23:
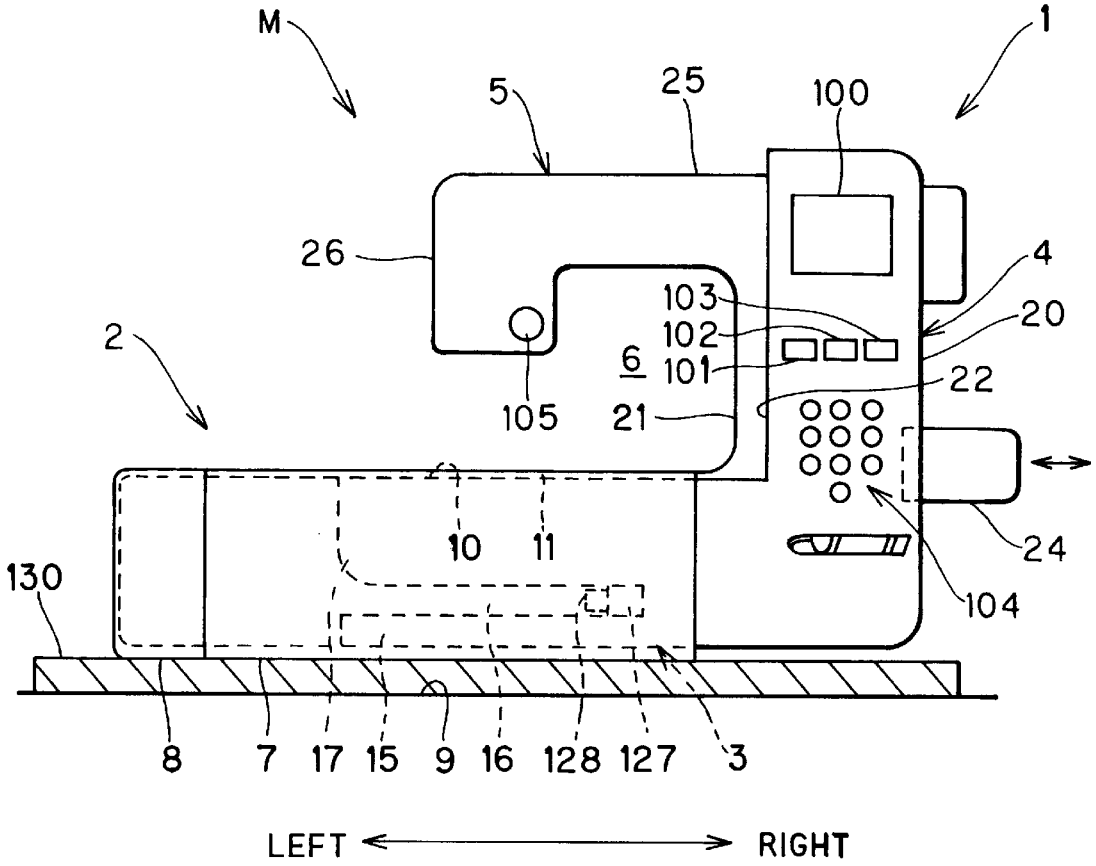
FIG. 23 is a front view showing a sewing machine according to a third modification of the embodiment.

Next, a third modification of the embodiment will be described while referring to FIG. 23. In the third modification, a plate-shaped low friction member 130 is attached to the lower surface of the sewing machine M. When the sewing machine M is placed on a table top or floor surface and the sewing machine cover 2 is used as a supplementary table, the low friction member 130 is disposed between the lower surface of the sewing machine cover 2 and the upper surface 9 of the table top or the floor. This enables the left-right embroidery-frame drive mechanism 60 to smoothly move the extension cover portion 8 leftward and rightward without excess friction.

What is claimed is:

1. A sewing machine comprising:

a bed portion extending in leftward and rightward directions and having an upper surface;

a column portion extending upright from the bed portion in a vertical direction perpendicular to the leftward and rightward directions;

an arm portion extending from the column portion over the upper surface of the bed portion, a space being defined between the bed portion and the arm portion; and a sewing machine cover at least partially covering the space between the bed portion and the arm portion, the sewing machine cover having a side that confronts the column portion, the sewing machine cover being open at said side, the sewing machine cover housing at least one of:

a left-right drive mechanism for driving an embroidery frame in the leftward and rightward directions across the work surfaces; and a front-rear drive mechanism for driving the embroidery frame in front and rear directions perpendicular to the leftward and rightward directions and to the vertical direction across the work surface.

2. A sewing machine as claimed in claim 1, wherein the sewing machine cover houses both the left-right drive mechanism and the front-rear drive mechanism and each of the left-right drive mechanism and the front-rear drive mechanism includes a motor.

3. A sewing machine as claimed in claim 1, further comprising at least one of a sewing machine motor and a transformer disposed in the column portion.

4. A sewing machine as claimed in claim 1, wherein the sewing machine cover is usable as a supplementary table to form a substantially continuous flush work surface in cooperation with the upper surface of the bed portion, the work surface having a greater surface area than the upper surface of the bed portion.

5. A sewing machine as claimed in claim 4, wherein:

the sewing machine cover is open at a side confronting the column portion with respect to an orientation when the sewing machine cover is used as a cover;

the sewing machine cover includes side walls that, when the sewing machine cover is used as a supplementary table, extend in the leftward and rightward directions and, when the sewing machine cover is used as a cover, extend in the vertical direction and at least partially cover the space between the bed portion to the arm portion; and at least one of the side walls being formed with an opening for, when the sewing machine cover is used as a supplementary table, engaging with the bed portion near the upper surface of the bed portion so that the bed portion, except for the upper surface of the bed portion, is housed in the sewing machine cover.

6. A sewing machine as claimed in claim 5, wherein the opening extends from the column portion in a same direction in which the arm portion extends from the column portion.

7. A sewing machine as claimed in claim 5, wherein the sewing machine cover houses both the left-right drive mechanism and the front-rear drive mechanism and includes:

a main cover portion; and an extension cover portion disposed, with respect to an orientation when the sewing machine cover is used as a cover, further from the column portion than the main cover portion, the extension cover portion housing the front-rear drive mechanism and forming a portion of the work surface when the sewing machine cover is used as a supplementary table.

8. A sewing machine as claimed in claim 5, wherein:

the opening is defined by edges of the at least one of the side walls, the edges being formed to a predetermined thickness; and the bed portion is formed with a step portion connected to the upper surface by a vertically extending side formed to the predetermined thickness.

9. A sewing machine as claimed in claim 5, wherein the side walls include an opening side wall formed with the opening and a solid side wall formed with no opening.

10. A sewing machine as claimed in claim 9, wherein the bed portion is formed with a free arm portion and base portion separated by a gap, the solid side wall extending into the gap when the sewing machine cover is used as a supplementary table.

11. A sewing machine as claimed in claim 9, wherein the solid side wall is disposed below the bed portion when the sewing machine cover is used as a supplementary table.

12. A sewing machine as claimed in claim 11, further comprising a leg disposed under the bed portion below the column portion, the leg being extendible in a direction opposite the vertical direction to a distance corresponding to thickness of the solid side wall.

13. A sewing machine as claimed in claim 11, wherein the bed portion includes a protrusion at a lower side thereof below the column portion, the protrusion extending in a direction opposite the vertical direction to a distance corresponding to thickness of the solid side wall and further comprising a leg disposed under the bed portion at a position below the upper surface, the leg being urged to, when the sewing machine cover is not used as a supplementary table, protrude in the direction opposite the vertical direction to the distance corresponding to thickness of the solid side wall.

14. A sewing machine as claimed in claim 4, wherein the sewing machine cover includes:

a main cover portion; and an extension cover portion disposed, with respect to orientation when the sewing machine cover is used as a cover, further from the column portion than the main cover portion, the extension cover portion housing the front-rear drive mechanism and forming a portion of the work surface when the sewing machine cover is used as a supplementary table.

15. A sewing machine as claimed in claim 14, wherein the sewing machine cover is formed so that when the sewing machine cover is used as a supplementary table, a downward facing surface of the extension cover portion is higher than a downward facing surface of the main cover portion.

16. A sewing machine as claimed in claim 15, wherein:

the arm portion extends leftward from the column portion;

the main cover portion includes side walls separated from each other by a distance and that extend in the leftward and rightward directions with respect to an orientation when the sewing machine cover is used as a supplementary table; and the extension cover portion includes front, rear, and left side walls, the front and rear side walls extending substantially in parallel with the side walls of the main cover portion, the left side wall connecting the front and rear side walls and extending orthogonally to the front and rear side walls to a distance shorter than the distances separating the side walls of the main cover portion.

17. A sewing machine as claimed in claim 15, wherein:

the arm portion extends leftward from the column portion;

the main cover portion includes front and rear side walls that, with respect to orientation when the sewing machine cover is used as a supplementary table, extend in the leftward and rightward directions, the front side wall extending further in the leftward direction than the rear side wall; and the extension cover portion includes a rear side wall extending in parallel with an in alignment with the rear side wall of the main cover portion, the extension cover portion being disposed above the front side wall of the main cover portion with respect to an orientation when the sewing machine cover is used as a supplementary table.

18. A sewing machine as claimed in claim 14, wherein:

the extension cover portion is formed with a slit in an edge between a side furthest from the main cover portion and another side; and the front-rear drive mechanism housed in the extension cover portion includes an embroidery frame attachment portion disposed in the extension cover portion and internally from the slit and adapted to attach the embroidery frame to the front-rear drive mechanism through the slit.

19. A sewing machine as claimed in claim 14, wherein the main cover portion houses the left-right drive mechanism, the left-right drive mechanism driving the extension cover portion and front-rear drive mechanism in the leftward and rightward directions during embroidery sewing operations.

20. A sewing machine as claimed in claim 19, further comprising a brake unit that stops drive of the left-right drive mechanism with the extension cover portion in contact with the main cover portion.

21. A sewing machine as claimed in claim 4, wherein the sewing machine cover houses both the left-right drive mechanism and the front-rear drive mechanism and further comprising:

a power circuit disposed in one of the bed portion, the column portion, and the arm portion;

a first electrical connector provided on an outer surface of the bed portion and electrically connected to the power circuit; and a second electrical connector electrically connected to the left-right drive mechanism and the front-rear drive mechanism and disposed at a position of the sewing machine cover so as to connect with the first electrical connector and bring the power circuit and the left-right and front-rear drive mechanisms into electrical connection when the sewing machine cover is used as a supplementary table.

22. A sewing machine as claimed in claim 4, wherein the sewing machine cover houses the front-rear drive mechanism adjacent to an edge between a side furthest from the column portion and another side and is formed with a slit in the edge and further comprising:

an embroidery frame attachment portion disposed internally from the slit and adapted to attach the embroidery frame to the front-rear drive mechanism through the slit.

* * * * *